US008961259B2

(12) United States Patent
Maggiore et al.

(10) Patent No.: US 8,961,259 B2
(45) **Date of Patent: *Feb. 24, 2015**

(54) TOY BUILDING BLOCKS

(71) Applicant: Mattel, Inc., El Segundo, CA (US)

(72) Inventors: Albert P. Maggiore, Lancaster, NY (US); Edward C. Teter, Elma, NY (US)

(73) Assignee: Mattel, Inc., El Segundo, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/741,984

(22) Filed: Jan. 15, 2013

(65) Prior Publication Data

US 2013/0143467 A1 Jun. 6, 2013

Related U.S. Application Data

(63) Continuation of application No. 12/655,100, filed on Dec. 23, 2009, now Pat. No. 8,382,548.

(60) Provisional application No. 61/152,522, filed on Feb. 13, 2009.

(51) Int. Cl.

| | |
|---|---|
| ***A63H 33/06*** | (2006.01) |
| ***A63H 33/04*** | (2006.01) |
| ***A63H 33/08*** | (2006.01) |

(52) U.S. Cl.

CPC ..... *A63H 33/04* (2013.01); *A63H 33/062* (2013.01); *A63H 33/065* (2013.01); *A63H 33/086* (2013.01)

USPC ..... 446/120; 446/121; 446/124; D21/484; D21/500; D21/501

(58) Field of Classification Search

CPC ..... A63H 33/12; A63H 33/06; A63H 33/26

USPC ..... 446/120–122, 85, 124–126, 128; 403/380, 292; D21/484, 499–502, 486

See application file for complete search history.

(56) References Cited

U.S. PATENT DOCUMENTS

| | | | | |
|---|---|---|---|---|
| 349,646 | A * | 9/1886 | Grigg | 446/128 |
| 1,895,611 | A * | 1/1933 | Doak | 434/403 |

(Continued)

FOREIGN PATENT DOCUMENTS

| | | | | |
|---|---|---|---|---|
| DE | 29901641 | U1 | 7/2000 | |
| GB | 1382134 | * | 1/1975 | A63H 33/08 |

(Continued)

OTHER PUBLICATIONS www.togls.com Tog'L™ Appreciation Site. In color, 10 pages. Undated. Retrieved from website Mar. 1, 2010.

(Continued)

*Primary Examiner* — Gene Kim

*Assistant Examiner* — Matthew B Stanczak

(74) *Attorney, Agent, or Firm* — Panitch Schwarze Belisario & Nadel LLP

(57) ABSTRACT

A toy building block set includes multiple polyhedron blocks of different lengths removably attachable together. Each block includes at least a top and four side walls. At least one connector extends from the top and includes opposing interior and exterior surfaces. A recessed area is provided at the bottom of each block. Engagement projections or depressions are provided on the connector and the remaining engagement structure are provided in the recessed area of each block where they might fully or partially engage or not engage with structures on the connector. The mechanical interference engagements and resulting engagement forces provided between any two of the blocks are less than three and even less than two times the number of engagements and resulting engagement forces provided by a mated pair of the smallest polyhedron blocks of the set.

18 Claims, 14 Drawing Sheets

(56) References Cited

U.S. PATENT DOCUMENTS

| | | | | | |
|---|---|---|---|---|---|
| 2,132,757 | A | | 10/1938 | Paulson | |
| D148,930 | S | | 3/1948 | Hickman | |
| 2,565,823 | A | | 8/1951 | Pool | |
| D181,962 | S | * | 1/1958 | Rudolf | D21/499 |
| 2,911,818 | A | * | 11/1959 | Smith | 52/592.3 |
| 3,148,477 | A | | 9/1964 | Bjphirn | |
| 3,195,266 | A | | 7/1965 | Onanian | |
| 3,205,611 | A | | 9/1965 | Onanian | |
| 3,224,137 | A | | 12/1965 | Wright et al. | |
| 3,367,063 | A | | 2/1968 | Bondesen et al. | |
| 3,374,917 | A | | 3/1968 | Troy | |
| 3,405,479 | A | | 10/1968 | Paulson | |
| 3,466,790 | A | | 9/1969 | Rady | |
| 3,496,670 | A | | 2/1970 | Sloop et al. | |
| 3,527,004 | A | | 9/1970 | Sorensen | |
| 3,534,518 | A | | 10/1970 | Zagray | |
| 3,554,384 | A | | 1/1971 | DeNatale | |
| 3,566,531 | A | | 3/1971 | Hasel | |
| 3,577,671 | A | | 5/1971 | Woollett | |
| 3,624,956 | A | | 12/1971 | Dunn et al. | |
| 3,659,358 | A | | 5/1972 | Brown | |
| 3,670,449 | A | | 6/1972 | Lemkin et al. | |
| 3,689,075 | A | | 9/1972 | Adelsohn | |
| 3,713,246 | A | | 1/1973 | Kilroy, Jr. | |
| 3,719,003 | A | * | 3/1973 | Skjoldborg | 446/121 |
| 3,729,881 | A | | 5/1973 | Disko | |
| 3,736,696 | A | | 6/1973 | Laird et al. | |
| 3,774,339 | A | * | 11/1973 | Swett | 446/121 |
| 3,803,754 | A | | 4/1974 | Fischer | |
| 3,867,784 | A | | 2/1975 | Lange | |
| 3,873,096 | A | * | 3/1975 | Shoptaugh | 273/156 |
| 3,877,170 | A | * | 4/1975 | Bakker | 446/124 |
| D235,570 | S | | 6/1975 | Barton | |
| 3,905,150 | A | * | 9/1975 | Dawn | 446/124 |
| 3,946,510 | A | | 3/1976 | Schubert | |
| 3,955,814 | A | | 5/1976 | Shallenberger | |
| 3,982,844 | A | | 9/1976 | De Anda et al. | |
| 4,003,144 | A | | 1/1977 | Maddestra et al. | |
| 4,027,424 | A | | 6/1977 | Kilroy, Jr. et al. | |
| 4,063,725 | A | | 12/1977 | Snyder | |
| 4,129,975 | A | | 12/1978 | Gabriel | |
| 4,135,327 | A | | 1/1979 | Sapkus et al. | |
| 4,195,437 | A | | 4/1980 | Ace | |
| 4,249,336 | A | * | 2/1981 | Moe et al. | 446/102 |
| 4,258,522 | A | | 3/1981 | Amaral | |
| 4,285,609 | A | | 8/1981 | Runyon | |
| 4,334,868 | A | | 6/1982 | Levinrad | |
| 4,529,385 | A | | 7/1985 | Reiner et al. | |
| 4,547,160 | A | | 10/1985 | Labelle | |
| 4,571,200 | A | | 2/1986 | Serna | |
| D283,635 | S | | 4/1986 | Kato et al. | |
| 4,605,383 | A | | 8/1986 | Horiuchi | |
| 4,667,962 | A | | 5/1987 | Ishiyama | |
| 4,673,373 | A | | 6/1987 | Herring et al. | |
| 4,676,762 | A | | 6/1987 | Ballard | |
| 4,685,892 | A | | 8/1987 | Gould et al. | |
| 4,698,023 | A | | 10/1987 | Marino | |
| D296,342 | S | | 6/1988 | Knudsen | |
| 4,764,143 | A | | 8/1988 | Gat et al. | |
| 4,813,903 | A | | 3/1989 | Furukawa et al. | |
| D306,188 | S | | 2/1990 | Tapdrup et al. | |
| 5,000,713 | A | | 3/1991 | Cheng | |
| 5,035,666 | A | * | 7/1991 | Kang | 446/118 |
| 5,049,105 | A | | 9/1991 | Glickman | |
| 5,055,083 | A | | 10/1991 | Walker et al. | |
| 5,078,354 | A | * | 1/1992 | Kim | 52/562 |
| 5,106,093 | A | * | 4/1992 | Engel | 273/160 |
| 5,137,452 | A | | 8/1992 | Pollock | |
| 5,176,577 | A | | 1/1993 | Pollock | |
| 5,238,407 | A | | 8/1993 | Pollock | |
| 5,238,408 | A | | 8/1993 | Pollock | |
| 5,261,849 | A | | 11/1993 | French | |
| 5,281,185 | A | | 1/1994 | Lee | |
| 5,282,767 | A | | 2/1994 | Gelardi | |
| 5,306,198 | A | | 4/1994 | Forman | |
| 5,354,224 | A | | 10/1994 | Ishiyama | |
| 5,372,450 | A | | 12/1994 | Blodgett | |
| 5,453,034 | A | * | 9/1995 | Larws | 446/103 |
| 5,458,522 | A | | 10/1995 | Brooks, III | |
| D369,100 | S | | 4/1996 | Johnson | |
| 5,503,288 | A | | 4/1996 | Conconi | |
| 5,523,129 | A | | 6/1996 | McGeehan-Hatch | |
| 5,542,871 | A | | 8/1996 | Gabriel | |
| 5,647,185 | A | | 7/1997 | Forlini | |
| 5,788,552 | A | | 8/1998 | Alioto | |
| 5,826,394 | A | | 10/1998 | Barton, Jr. et al. | |
| D403,028 | S | * | 12/1998 | Barton et al. | D21/486 |
| 5,846,113 | A | | 12/1998 | Nielsen et al. | |
| 5,848,927 | A | | 12/1998 | Frederiksen | |
| D409,680 | S | | 5/1999 | Krog | |
| D410,041 | S | | 5/1999 | Jensen | |
| D411,591 | S | * | 6/1999 | Laserna Fernandez | D21/500 |
| 5,908,342 | A | | 6/1999 | Wolvin | |
| 5,924,906 | A | | 7/1999 | Grafton | |
| D413,636 | S | * | 9/1999 | Laserna Fernandez | D21/499 |
| 5,993,282 | A | | 11/1999 | Ernst | |
| 6,003,706 | A | | 12/1999 | Rosen | |
| 6,004,182 | A | | 12/1999 | Pasin | |
| D422,036 | S | * | 3/2000 | Laserna Fernandez | D21/499 |
| 6,086,444 | A | * | 7/2000 | Glickman | 446/124 |
| 6,162,108 | A | | 12/2000 | Frederiksen | |
| 6,176,757 | B1 | | 1/2001 | Lin | |
| D437,366 | S | * | 2/2001 | Stemmler | D21/499 |
| 6,322,414 | B1 | | 11/2001 | Lin | |
| 6,447,360 | B1 | | 9/2002 | Sorensen | |
| D464,682 | S | | 10/2002 | Lin | |
| 6,461,215 | B1 | | 10/2002 | Kunz et al. | |
| D466,956 | S | | 12/2002 | Manville et al. | |
| D468,779 | S | | 1/2003 | Manville et al. | |
| D469,825 | S | | 2/2003 | Manville et al. | |
| 6,527,609 | B1 | | 3/2003 | Rowland et al. | |
| D480,437 | S | | 10/2003 | Stoneberg | |
| D481,767 | S | | 11/2003 | May et al. | |
| 6,669,526 | B2 | | 12/2003 | Manville et al. | |
| 6,672,189 | B1 | | 1/2004 | Aiken et al. | |
| 6,702,640 | B1 | | 3/2004 | Park | |
| D490,483 | S | | 5/2004 | Auberger | |
| 6,746,297 | B2 | | 6/2004 | Robjent et al. | |
| 6,790,118 | B2 | | 9/2004 | Ahn | |
| D509,858 | S | | 9/2005 | May et al. | |
| D512,748 | S | | 12/2005 | Hageman | |
| 7,014,524 | B2 | | 3/2006 | Farmer Brock et al. | |
| D546,900 | S | | 7/2007 | Sorensen | |
| D546,901 | S | | 7/2007 | Sorensen | |
| 7,413,128 | B2 | | 8/2008 | Waldo et al. | |
| D616,044 | S | | 5/2010 | Tervo | |
| 2002/0106963 | A1 | * | 8/2002 | Chiu | 446/125 |
| 2003/0013374 | A1 | | 1/2003 | Lin | |
| 2004/0082256 | A1 | | 4/2004 | Ahn | |
| 2005/0191932 | A1 | | 9/2005 | Lin | |
| 2005/0245167 | A1 | | 11/2005 | Sinisi | |
| 2006/0160467 | A1 | | 7/2006 | Brock et al. | |
| 2006/0234597 | A1 | | 10/2006 | Jaeger | |
| 2008/0045115 | A1 | | 2/2008 | Leleu | |
| 2008/0172965 | A1 | | 7/2008 | Yin et al. | |
| 2010/0210172 | A1 | * | 8/2010 | Worthington et al. | 446/124 |

FOREIGN PATENT DOCUMENTS

| | | | |
|---|---|---|---|
| GB | 2185192 | B | 4/1990 |
| JP | 2000167258 | A | 6/2000 |
| WO | 9811969 | A1 | 3/1998 |
| WO | 2007076607 | A1 | 7/2007 |
| WO | 2007081094 | A1 | 7/2007 |
| WO | 2009/036709 | A3 | 7/2009 |

OTHER PUBLICATIONS

Mattel Tog'l "At a Glance Information" Review of Tog'l product. In color, 13 pages. Undated.

* cited by examiner

TOY BUILDING BLOCKS

CROSS-REFERENCE TO RELATED APPLICATIONS

The present application is a continuation of U.S. patent application Ser. No. 12/655,100 filed Dec. 23, 2009 and claims the benefit of U.S. Provisional Patent Application No. 61/152,522, filed on Feb. 13, 2009 and entitled "Toy Building Blocks", both of which are herein incorporated by reference in their entirety.

BACKGROUND OF THE INVENTION

The present invention relates generally to a toy building block and, more particularly, to a set of rectilinear polyhedron toy building blocks configured and/or designed to have a predetermined and generally consistent attraction and/or removal force between various sized and shaped blocks.

Toy building block sets are generally known. Toy building block sets are often an important part of a child's learning and development process. Conventional building block sets allow children to use their imagination and/or creativity to build and/or create a generally limitless number of configurations and/or structures. Conventional toy building block sets also include a variety of differently sized and/or shaped blocks that require varying degrees of attraction and/or removal force applied by the user to attach and/or detach various combinations of differently sized and/or shaped blocks. As a result, certain combinations of blocks may be more difficult to attach/detach and children of a certain young age may not be developed sufficiently to have the strength and/or dexterity to be capable of attaching and/or detaching the various blocks.

Therefore, it would be desirable to create a toy building block set that is configured for children of a wide range of ages and abilities. It would be desirable to create a set that includes a variety of differently sized and/or shaped blocks that can be attached and/or detached with a predetermined, relatively low and generally consistent attachment and/or detachment force between any of the blocks. Specifically, it would be desirable to create a toy building block set that includes at least two single square blocks and at least two of two, three, four and five square blocks that each include structure that is sized and shaped to maintain generally consistent and/or equal attachment and/or detachment force(s) between any of the various blocks regardless of the types of blocks that are connected.

BRIEF SUMMARY OF THE INVENTION

In one aspect the invention is a first rectilinear polyhedron toy building block comprising: a top wall; four side walls extending orthogonally away from the top wall to a bottom end of the block, each of the four side walls having an interior surface generally facing a geometric center of the block and an opposing exterior surface exposed outside of the block; at least one connector extending away from the top wall in a direction opposite the four side walls, the at least one connector including a plurality of partitions, each partition having an interior surface facing a geometric center of the connector and an opposing exterior surface, a free end and an opposing end affixed with the top wall; and a bottom wall spaced apart from the top wall and extending across the bottom end of the block within the four side walls.

In another aspect, the invention is a toy building block set comprising: a first block and a second block essentially identical to the first block, each of the first and second blocks being a cubic polyhedron and including a top wall defining a top end of the block, four side walls of equal area to the top wall extending orthogonally away from the top wall toward a bottom end of the block, wherein the first and second blocks are removably attachable with one another top to bottom and wherein a first predetermined force is required to remove the second block from the first block; and a third block and a fourth block essentially identical to the third block, each of the third and fourth blocks being a rectilinear polyhedron and including a top wall defining a top end of the block, four side walls extending orthogonally away from the top wall toward a bottom end of the block, at least the top wall and two of the side walls being at least three times the length of a remaining two side walls, wherein the third and fourth blocks are removably attachable to one another and wherein each of the first and second blocks is releasably attachable top to bottom with other of the third and fourth blocks; wherein a second predetermined force is required to remove the fourth block from the third block and the second predetermined force is less than three times the first predetermined force.

In yet another aspect, the invention is a toy building block set comprising: a first rectilinear polyhedron block and a second rectilinear polyhedron block removably attachable to the first rectilinear polyhedron block, a length, width and height of each of the first and second rectilinear polyhedron blocks being generally equal, wherein a first predetermined force is required to remove the second rectilinear polyhedron block from the first rectilinear polyhedron block; and a third rectilinear polyhedron block and a fourth rectilinear polyhedron block removably attachable to the third rectilinear polyhedron block, wherein two of a length, width and height of each of the third and fourth rectilinear polyhedron blocks are generally equal in distance and one of the length, width and height of each of the third and fourth rectilinear polyhedron blocks is at least three times a distance of the other two, and wherein a second predetermined force required to remove the fourth rectilinear polyhedron block from the third rectilinear polyhedron block is less than three times the first predetermined force required to remove the second rectilinear polyhedron block from the first rectilinear polyhedron block.

BRIEF DESCRIPTION OF THE SEVERAL VIEWS OF THE DRAWINGS

The foregoing summary, as well as the following detailed description of the preferred embodiment of the invention, will be better understood when read in conjunction with the appended drawings. For the purpose of illustrating the invention, there is shown in the drawings embodiments which are presently preferred. It should be understood, however, that the invention is not limited to the precise arrangements and instrumentalities shown.

In the drawings.

DETAILED DESCRIPTION OF THE INVENTION

Figure 1:
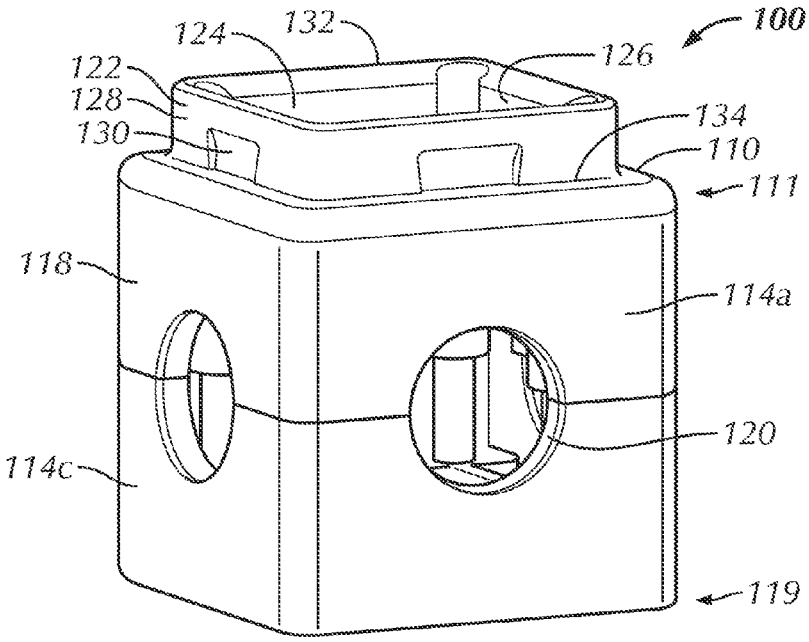
FIG. 1 is a top perspective view of a single square building block (i.e., 1×1 block) in accordance with a preferred embodiment of the present invention
Figure 2:
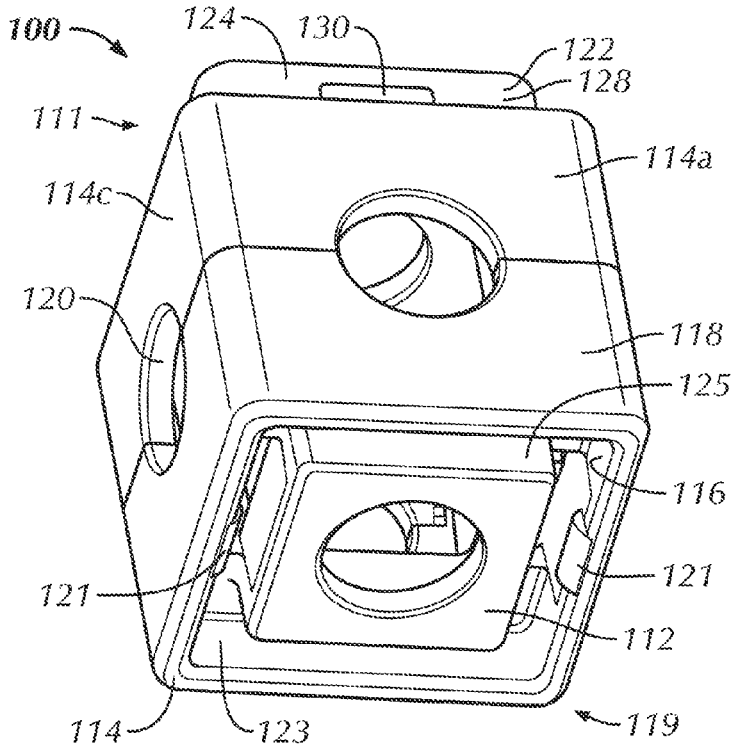
FIG. 2 is a bottom perspective view of the single square building block shown in FIG. 1.

Certain terminology is used in the following description for convenience only and is not limiting. The words "right," "left," "upper," and "lower" designate directions in the drawings to which reference is made. The words "first" and "second" designate an order or operations in the drawings to which reference is made, but do not limit these steps to the exact order described. The words "inwardly" and "outwardly" refer to directions toward and away from, respectively, the geometric center of the blocks and/or set and designated parts thereof. The term "multi-" is defined herein as "three or more." Additionally, the terms "a," "an" and "the," as used in the specification, mean "at least one." The terminology includes the words above specifically mentioned, derivatives thereof, and words of similar import.

Referring to the drawings in detail, wherein like numerals indicate like elements throughout, there is shown in FIGS. 1-27 a preferred embodiment of a toy building block set, generally designated 600 (FIG. 26), in accordance with the present invention. Although reference is made specifically to the set 600 or collection of building blocks, rods 602, panels 604 and/or other building accessories 702, 704, 706 configured to be combined to form a generally limitless number of arrangements or structures, it is understood by those skilled in the art that any number of the components of the set 600 may be employed and/or attached as described herein.

Referring to FIGS. 1-26, the toy building block set 600 includes a progressively increasing-in-size series of building blocks or beams and/or a plurality of differently sized and shaped building block or beams. Specifically, the set 600 preferably includes at least one generally cubic block, having six orthogonal sides of substantially equal areas and dimensions, also referred to as a single square building block (i.e., 1×1 block), generally designated 100 (FIGS. 1-8). The 1×1 reference is to the relative height to length ratio of the square side walls. However, the at least one single building block 100 may be formed in a variety of shapes, such as a cylinder or a truncated sphere, for example, or with other shapes, some examples of which will be described. Set 600 further preferably includes at least one double or two square building block (i.e., 1×2 block), generally designated 200 (FIGS. 9-12), at least one triple or three square building block (i.e., 1×3 block), generally designated 300 (FIGS. 13-16), at least one quadruple or four square building block (i.e., 1×4 block), generally designated 400 (FIGS. 17-20), and at least one quintuple or five square building block (i.e., 1×5 block), generally designated 500 (FIGS. 21-24). Each block 100, 200, 300, 400, 500 is preferably a rectilinear and/or cubic polyhedron and is removably attachable to one or more of the remaining blocks of the set 600. However, the set 600 may include blocks of other sizes, such as but not limited to a 2×3 block or a 1×6 block, and different shapes. The basic double, triple, quadruple and quintuple blocks 200, 300, 400, 500 are generally based on integer multiples of the single square block 100. Despite the differences in size and/or shape, the blocks 100, 200, 300, 400, 500 described below are generally similar, but not identical, especially with respect to releasable engagement components (i.e., projections and depressions, as described in detail below) that are generally asymmetrically configured and releasably hold together various blocks 100, 200, 300, 400, 500 of the set 600 when they are stacked together top to bottom.

As described in detail below, the location of projections and depressions of each building block 100, 200, 300, 400, 500 is such that the engagement(s) and resulting force(s) (i.e., attachment/engagement force and/or detachment/removal force) releasably joining together multi-square building blocks is/are less than a corresponding integer multiple of the same force and/or engagement produced by two (2) identical single square blocks 100 removably attached together, where the term "multi-square block" includes the triple, quadruple, quintuple blocks 300, 400, 500 and/or any larger blocks but not the single or double building blocks 100, 200. That is, for example, the engagements and resulting forces needed to attach and/or separate a pair of fully engaged, identical triple building blocks 300 is less than three times, and preferably no greater than two and one-half (5/2) times the force and/or engagements needed to separate a pair of fully engaged, identical single square blocks 100. In conventional building block sets, the engagement(s) and resulting magnitude of the attachment and/or detachment force(s) increase(s) as a multiple of the length of the block, making it very difficult for a child to separate longer blocks or beams, e.g. a quintuple block attached to another quintuple block. More specifically, the size, shape and/or location of the projections and depressions of blocks 100, 200, 300, 400, 500 of the present invention are varied to reduce the "clutch" force and/or engagement(s) on the multi-square blocks 300, 400, 500 and so all of the blocks 100, 200, 300, 400, 500 are easier to attach together and/or separate when connected.

For the sake of brevity, only a detailed description of the single building block 100 will be discussed herein. Common features and/or structure between the various sized and shaped blocks will be identified with common reference numerals throughout, differing only in the appropriate hundreds numeral. However, differing features and/or structure between the various sized and shaped blocks will be described in detail below.

Figure 3:
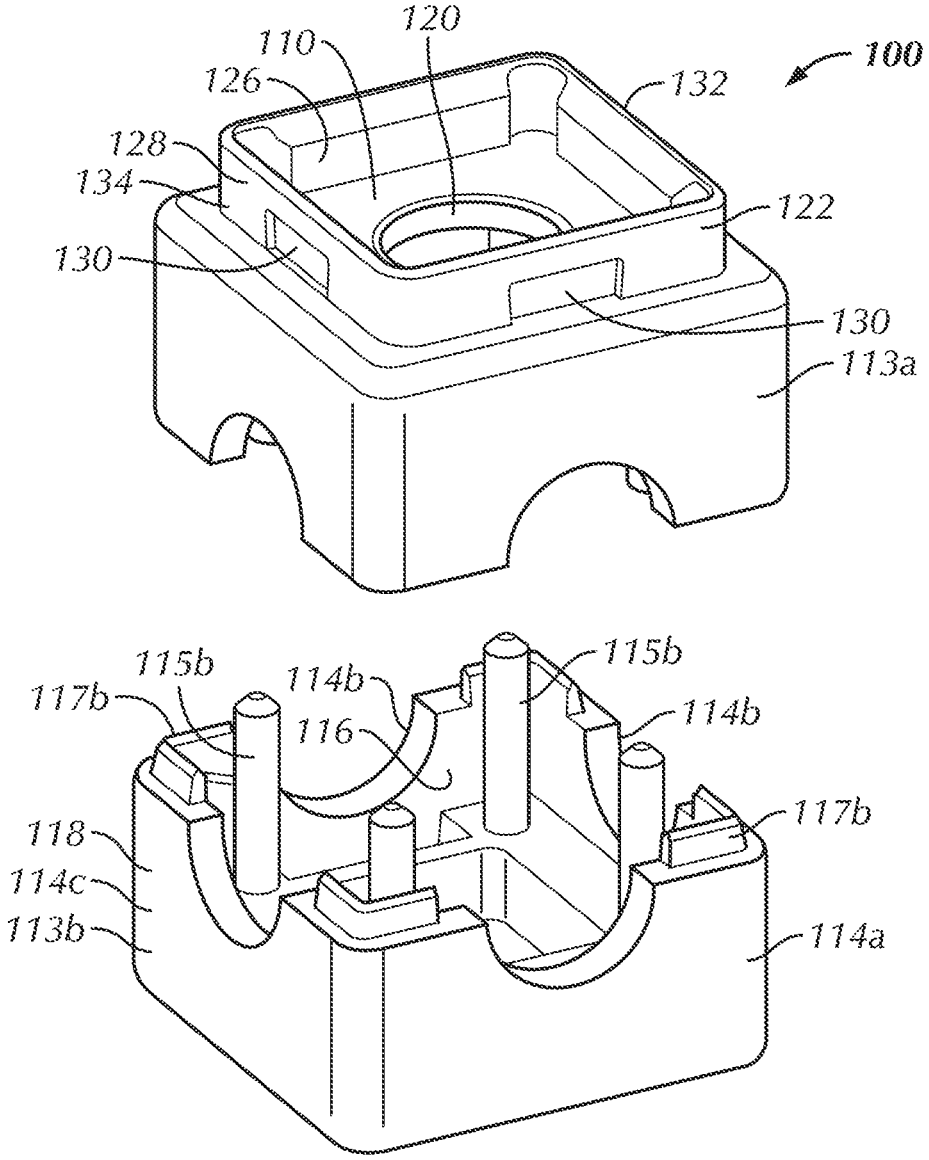
FIG. 3 is a partially exploded top perspective view of the single square building block shown in FIGS. 1 and 2, with a first or upper portion spaced-apart from a second or lower portion.
Figure 4:
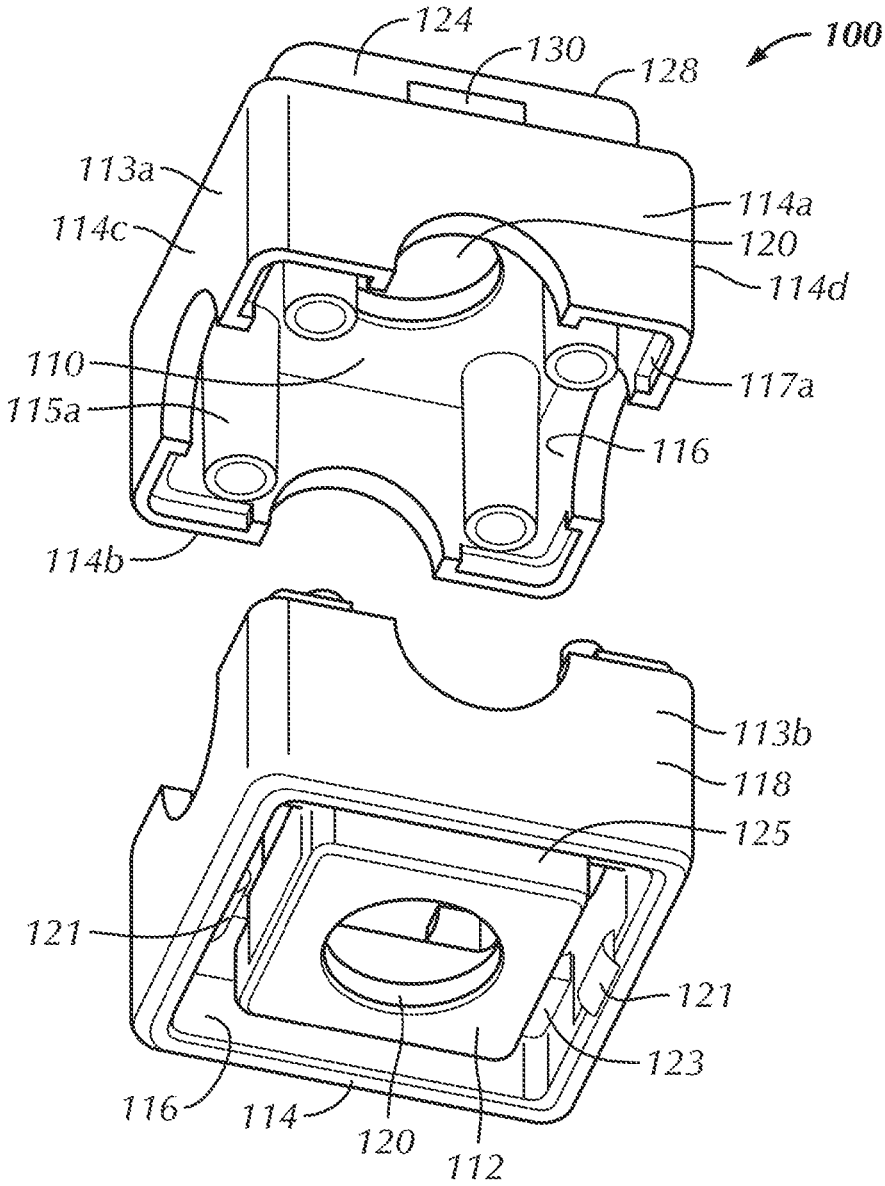
FIG. 4 is a partially exploded bottom perspective view of the single square building block shown in FIGS. 1-3, with the first portion spaced-apart from the second portion.

As seen in FIGS. 1-8, the single building block 100 preferably includes a first or top wall 110 across a top end 111 of the block 100 and an opposing second or bottom wall 112 across an opposing bottom end 119 of the block 100. The bottom wall 112 is spaced a predetermined distance apart from and extends generally parallel to the top wall 110. A plurality of generally flat or planar side walls 114 and, more specifically four side walls 114, extend generally orthogonally away from the top wall 110 to the bottom end 119 and the bottom wall 112. As seen in FIGS. 3 and 4, the single square block 100 is preferably formed of a first or top portion 113*a* and a complimentary second or bottom portion 113*b*. However, the block 100 may be formed of a single, single mold, unitary construction.

In the preferred embodiment, the top portion 113*a* is fixedly attached, by adhesive, sonic bonding or friction-fitting, for example, to the bottom portion 113*b*. However, the top and bottom portions 113*a*, 113*b* may be removably attached. For example, as seen in FIGS. 3 and 4, the bottom portion 113*b* may include four (4) spaced-apart posts 115*b* extending generally parallel to and spaced inwardly from the side walls 114. Further, the top portion 113*a* may include four (4) spaced-apart sockets 115*a*, extending generally parallel to and spaced inwardly from the side walls 114. Each socket 115*a* is preferably sized and shaped to receivable engage at least a portion of one of the posts 115*b*. Additionally or alternatively, the top portion 113*a* of the block 100 may define a cut-out or groove 117*a* (FIG. 4) that extends downwardly from an outer periphery thereof to matingly receive a portion of a lip 117*b* (FIG. 3) that extends upwardly from an outer periphery of the bottom portion 113*b*. In the embodiment that includes both the posts 115*b* and the lips 117*b*, a top point of each post 115*b* preferably extends above a top point of the lip 117*b*.

It will be appreciated that the sockets 115*a* and posts 115*b* provide a separate and additional form of mechanical engagement between the top and bottom portions 113*a*, 113*b* to that provided by the grooves 117*a* and lips 117*b* and that one pair 115*a*, 115*b* or 117*a*, 117*b* might be omitted. It will further be appreciated that both pairs of engagement elements 115*a*, 115*b* and 117*a*, 117*b* might be omitted and that free distal ends of the side walls 114 of a pair of top and bottoms portions 113*a*, 113*b* may be butted together and joined by adhesion or weld.

Referring back to FIGS. 1 and 2, the plurality of side walls 114 preferably include a planar front or first side wall 114*a*, an opposing planar rear or second side wall 114*b*, a planar left or third side wall 114*c* and an opposing right or fourth side wall 114*d*. The front side wall 114*a* extends generally parallel to the rear side wall 114*b* and both side walls 114*a*, 114*b* extend generally perpendicularly to the left and right side walls 114*c*, 114*d*. A generally arcuate corner preferably defines an intersection of two adjacent side walls 114. The illustrated blocks also include an arcuate corner between each side wall 114 and the top wall 110. Each of the top wall 110, bottom wall 112 and side walls 114 has an outer perimeter that preferably defines an approximately one (1) inch square surface and, thus, the top wall 110, bottom wall 112 and side walls 114 have a generally equal surface area. However, the walls 110, 112, 114 are not limited to this size and configuration. In the preferred embodiment, each single building block 100 (apart from its "connector(s)" defined below) has the same (generally equal) length "L," width "W" and height "H" (FIG. 7), each dimension being approximately one (1) inch.

As seen in FIGS. 3 and 4, in the preferred embodiment, each side wall 114 has an interior surface 116 that generally faces a geometric center of the block 100 and an opposing exterior surface 118. Further, as seen in FIGS. 1-8, each wall 110, 112, 114 preferably includes an opening or passageway 120 that surrounds a geometric center thereof. Preferably the openings 120 are essentially identical in shape and centered in its respective wall 110, 112, 114. Each opening 120 preferably is sized and shaped to receive at least an end portion of a building rod or shaft 602 (see FIGS. 7 and 26-28). More preferably, each opening 120 is circular with a diameter of about three eights ($3/8^{th}$) of an inch.

Figure 8:
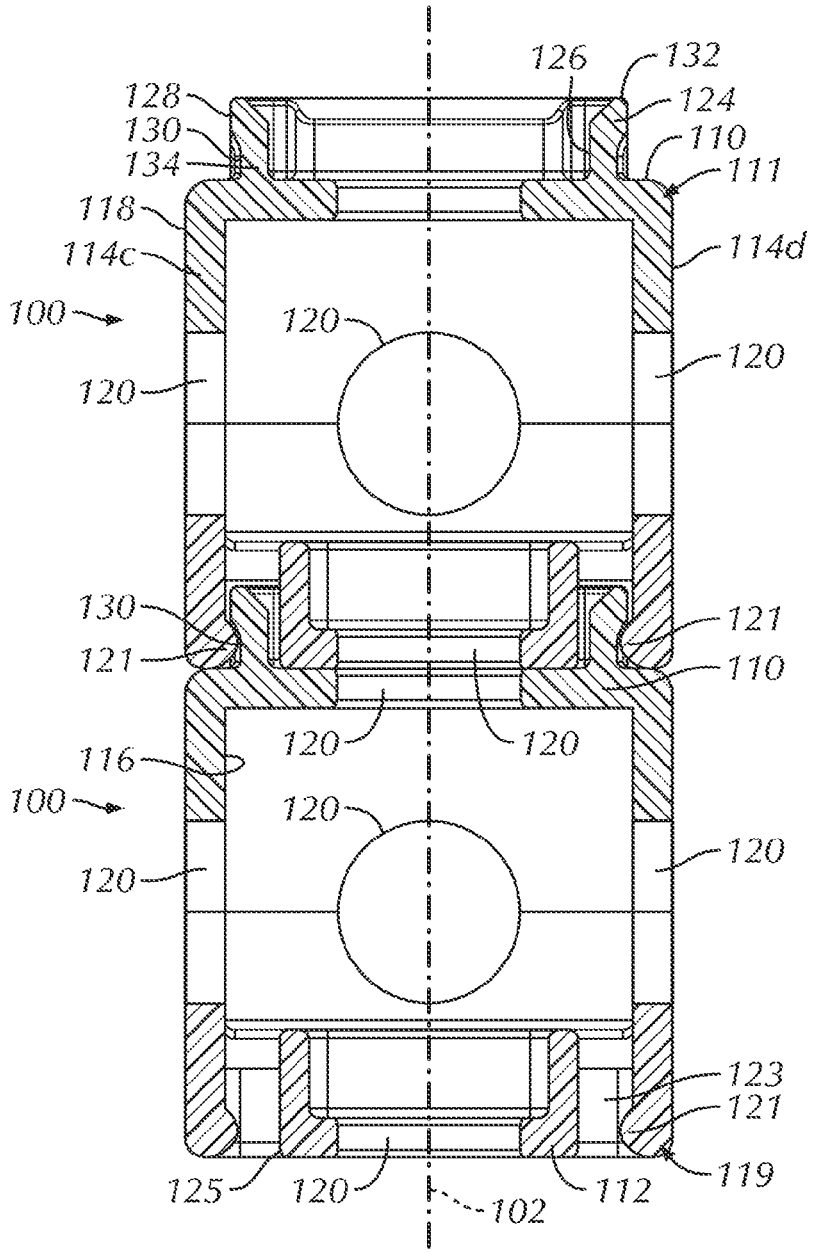
FIG. 8 is a cross-sectional elevation view of a first single square building block releasably connected to the first or upper portion of a second single building block.
Figure 9:
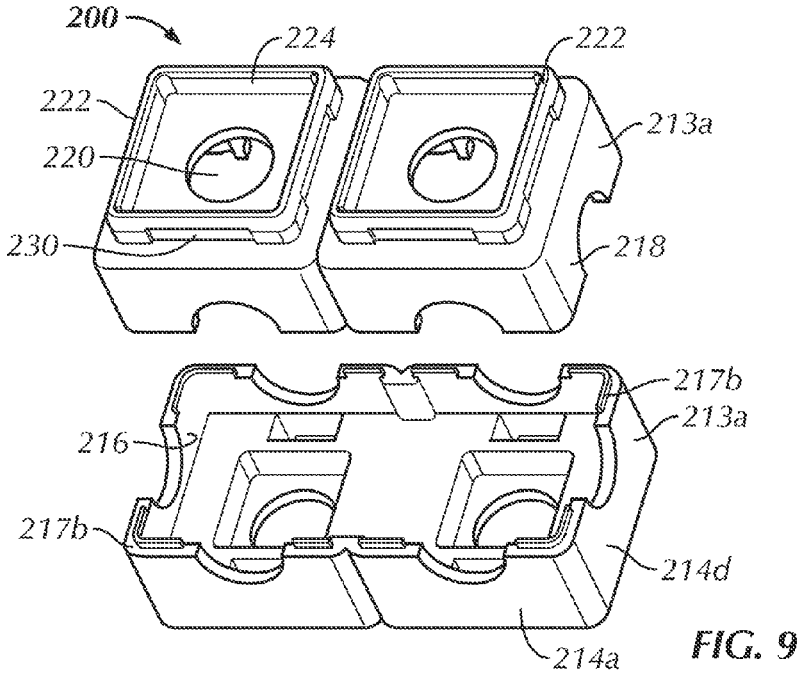
FIG. 9 is a top perspective view of a partially exploded double or two square building block (i.e., 1×2 block) in accordance with a preferred embodiment of the present invention.

Referring to FIGS. 2, 4, 6 and 8, the bottom wall 112 preferably includes an outer recessed area 123 that surrounds a central area 125 and exposes the interior surfaces 116 of the side walls 114 at the bottom end 119. At least one projection or protuberance 121 preferably extends generally orthogonally inwardly from the interior surface 116 of at least one but preferably two opposing side walls 114 of the single building block 100. Each projection 121 preferably has a generally smooth, arcuate exterior profile when viewed from the side (FIG. 8) and is preferably horizontally centrally located on the interior surface 116 of the respective side wall 114 proximal and between bottom end 119 and recessed portion 123 of bottom wall 112 of the block 100. In the preferred embodiment, a length "$l_p$" of each projection 121, as measured from one lateral end to the other, is preferably approximately three sixteenths ($3/16^{th}$) of an inch (see FIG. 6). As seen in FIG. 8, a vertically center portion of each projection 121 is the furthest point thereof from the interior surface 116 of the respective side wall 114. Although each side wall 114 may contain a projection 121 or only one side wall 114 may contain the projection 121, mirror image projections 121 on two (2) opposing side walls 114 are ideal for maintaining generally consistent and balanced engagements and resulting attachment and/or detachment force(s) between blocks of varying size and shape. Further, each projection 121 is not limited to the size, shape and location described above, but may be modified as deemed necessary to accomplish the objectives defined herein.

Figure 5:
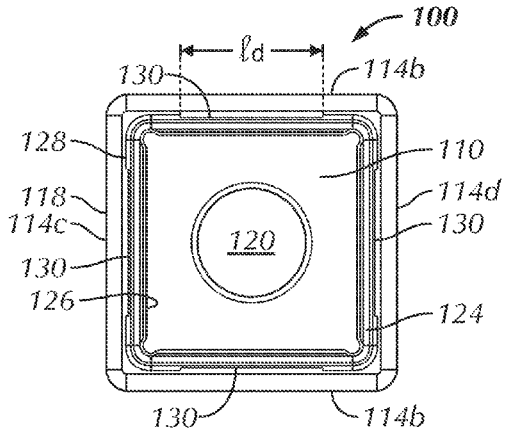
FIG. 5 is a top plan view of the single square building block shown in FIGS. 1-4.
Figure 6:
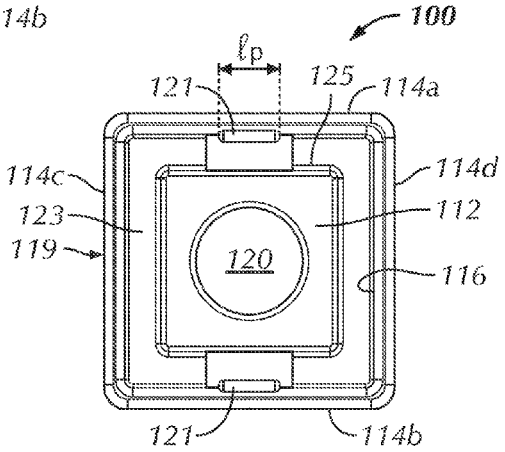
FIG. 6 is a bottom plan view of the single square building block shown in FIGS. 1-5.
Figure 7:
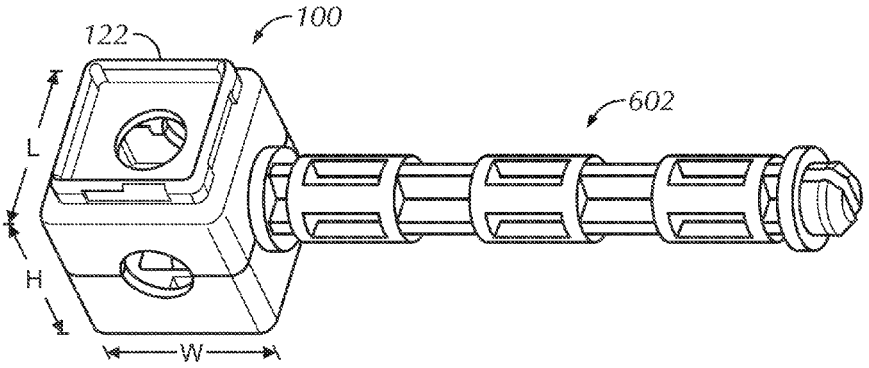
FIG. 7 is a perspective view of the single square building block shown in FIGS. 1-6 releasably connected to a rod.

Referring to FIGS. 1-5 and 7-8, at least one connector 122 extends generally orthogonally upwardly away from the top wall 110 of the block 100. The at least one connector 122 preferably 7 includes a plurality of partitions 124 each having an interior surface 126 generally facing the geometric center of the block 100 and an opposing exterior surface 128. In the preferred embodiment, four (4) partitions 124 collectively comprise the connector 122, where adjacent partitions 124 extending generally perpendicular to one another. As seen in FIGS. 5 and 8, the exterior surface 128 of each partition 124 is spaced a predetermined distance inwardly away from the exterior surface 118 of a most proximal one of the plurality of side walls 114. In the preferred embodiment, at least one of the plurality of partitions 124 extends generally parallel to and is spaced a predetermined distance inwardly, such as two (2) millimeters, from a most proximal one of the plurality of side walls 114 when viewing the block 100 from above. Further, each of the plurality of partitions 124 includes a first or free end 132 and an opposing second or fixed end 134 that is attached directly to the top wall 110.

Referring to FIGS. 2, 4, 6 and 8, when viewing the single building block 100 from below (FIG. 6), the recessed area 123 generally surrounds the opening 120 and central area 125 and extends inwardly (upwardly) from the bottom end 119 of the single building block 100. The recessed area 123 is generally sized and shaped to receive therein one of the connectors 121 and each of the partitions 124 of the connector 121 while the connector 121 is sized and shaped to be received between the central area 125 and the side walls 114 when the top of a first block 100 is attached to the bottom of a second, identical block 100.

At least one but preferably two opposing partitions 124 include at least one depression 130 formed in the exterior surface 128 thereof. Each depression 130 of the block 100 is sized and shaped to fully receive at least one of the projections 121 of an identical block 100 to releasably join the blocks together. The entire depression 130 of each partition 124 is preferably positioned a predetermined distance below the first end 132 and a lower end of each depression 130 extends to the second end 134. Each depression 130 is preferably horizontally centered on its respective partition 124. More preferably, in the present embodiment, a length "$l_d$" of each depression 130, as measured from one lateral end to the other, is approximately seven sixteenths ($7/16^{th}$) of an inch (see FIG. 5). Thus, the length "$l_d$" of each depression 130 is more than twice a length "$l_p$" of each projection 121, but vertically aligned projections 121 and depression 131, whether on the same single square block 100 or separate single square blocks 100, have a horizontal midpoint along a common vertical plane 102 (see FIG. 8), bisecting each block 100 and perpendicular to an opposing pair of the sidewalls 114 and the top and bottom walls 110, 112 being bisected and parallel to the remaining pair of side walls 114. In the preferred embodiment, the exterior surface 128 of each partition 124 includes a depression 130 therein, such that the two blocks 100 may be joined together at any one of four (4) rotational positions (i.e., corresponding to the four side walls 114) of the first block 100 with respect to the second block 100.

Figure 31:
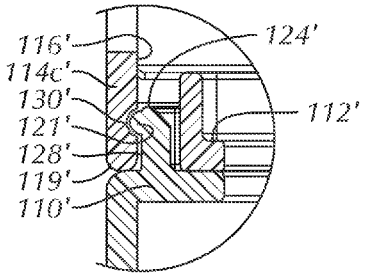
FIG. 31 depicts a reversal of the locations of the depressions and protrusions with respect to the side walls and partition walls.

FIG. 31 depicts an alternative arrangement of releasable engagement structures with projections or protuberances 121' projecting orthogonally away from the exterior surface(s) 128' of partition(s) 124' and mating depression(s) 130' formed within the interior surface(s) 116' of side wall(s) 114' proximal the bottom end 119'.

Figure 26:
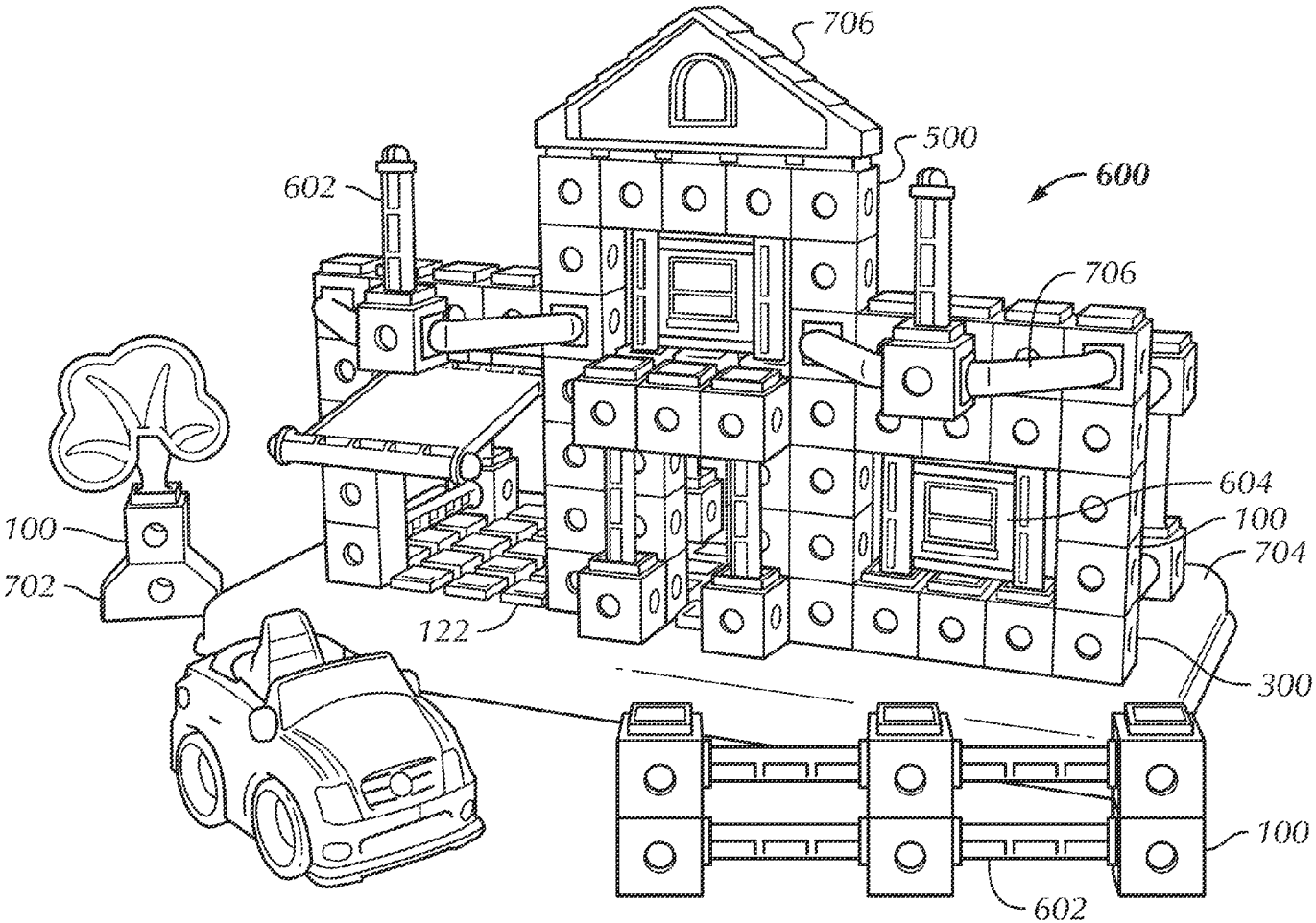
FIG. 26 is a perspective view of various building blocks combined with a base building plate, rods, window panels and other building accessories in another exemplary configuration.

In operation, and as seen in FIG. 8, the two or more identical single building blocks 100 are vertically stackable, top to bottom, such that a connector 122 of one of the blocks 100 is insertable and removably engageable into one of a recessed areas 123 of another block 100. During attachment of two blocks 100, an audible noise, such as a snapping or clicking sound, is preferably produced as the projection(s) 121 slide over the top end 132 of a partition 124 and slide into one of the depressions 130 in the exterior surface 128 thereof. The above-described structure of each block 100 allows for a generally limitless number of blocks 100 to be stacked in a stable manner on top of each other. As seen in FIG. 26, it is preferred that the set 600 includes a base building plate or platform 704 that includes a plurality of uniformly spaced-apart connectors 122, such that at least one of the single building blocks 100 may be removably engageable with at least a portion of the platform 704.

For reasons that will be subsequently understood, the engagement/disengagement of a pair of the single building blocks 100 with one another can be defined in the terms of their physical structure, in particular, the provided projections 121 and depressions 130. Regardless of their rotational position, when two single building blocks 100 engage top to bottom, an interference engagement is made by the full length of the two equal length projections 121 of the top single building block 100 (i.e., 2×3/16 inch) with two of the four generally identical depressions 130 around the connector 121 of the bottom single building block 100. That combination will hereinafter be referred to as a basic or single block engagement.

As is understood by those skilled in the art, the basic block engagement gives rise to a predetermined attachment force that is required to engage the projections 121 with the depressions 130 and, thus, connect one square building block 100 to another. In the preferred embodiments being described, a predetermined detachment force generally equal to the attachment force is required to slide the projections 121 out from the depressions 130 and, thus, disconnect one single building block 100 from another. In addition, there may be some frictional forces generated, such as by the fit of the connector 122 of the bottom block 100 with the sides of the recessed area 123 of the upper block 100 and/or flexing of one or more of the partitions 124 based on the location of the projection 121 and/or depression 130, frictional characteristics of the polymer material selected, and other factors. For the sake of simplicity and ease of explanation with respect to the remaining blocks 200, 300, 400, 500, the attachment/detachment force(s) of two (2) stacked single square blocks 100 will be considered herein to each be equal to one (1) force unit.

Referring to FIGS. 9-12, the double building block 200 is substantially similar to the single building block 100 described above. The double building block 200 is essentially two (2) single "blocks" 206 fixedly attached in a side-by-side configuration preferably with parts of the facing sidewalls 114 removed. Thus, a primary difference is that a generally planar front (first) side wall **214*a* and an opposing generally planar rear (second) side wall 214*b* of the double building block 200 are generally twice the length of a generally planar left (third) side wall 214*c* and an opposing generally planar right (fourth) side wall 214*d*. Right and left sidewalls 214*c*, 214*d* are essentially identical to sidewalls 114 of block 120. Specifically, the top, bottom, front and rear side walls 210, 212, 214*a*, 214*b* are relatively longer being approximately two (2) inches in length and the left and right side walls 214***c*, 214*d* are relatively shorter remaining approximately one (1) inch in length. In the preferred embodiment, the top, bottom, front and rear side walls 210, 212, 214*a*, 214*b* include two (2) spaced-apart openings 220 therein, while the left and right side walls 214*c*, 214*d* include a single opening 220 therein. "Blocks" 206 are defined from double building block 200 by a vertical transverse plane 204 bisecting the top, bottom, front and rear side walls 210, 212, 214*a*, 214*b*.

Figure 10:
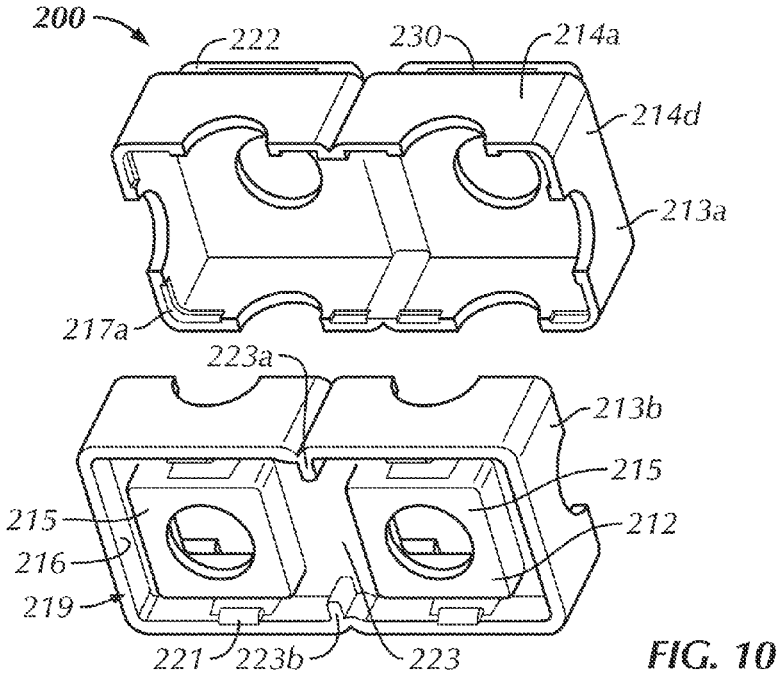
FIG. 10 is a bottom perspective view of the partially exploded double or two square building block shown in FIG. 9.
Figure 11:
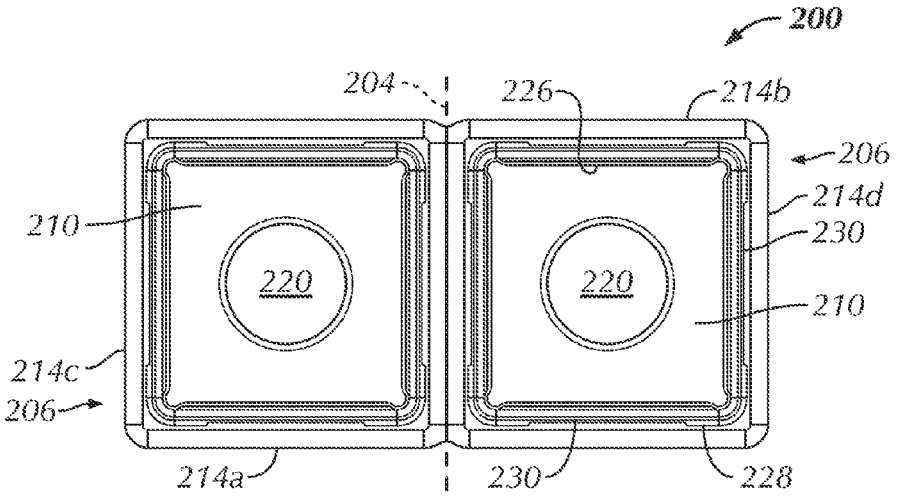
FIG. 11 is a top plan view of the double or two square building block shown in FIGS. 9-10.
Figure 12:
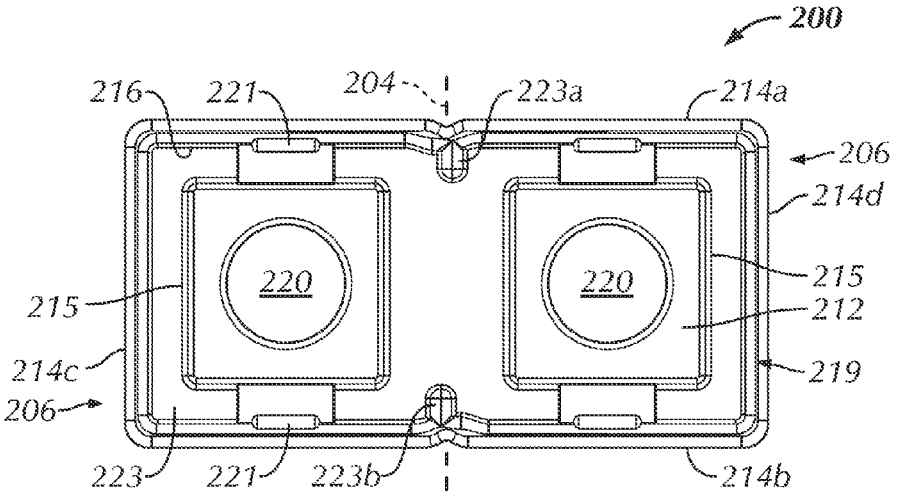
FIG. 12 is a bottom plan view of the double or two square building block shown in FIGS. 9-11.

Another difference from the single block 100 is that the double block 200 includes two (2) preferably identical, spaced-apart, in line connectors 222 (i.e., first and second), each preferably including four (4) partitions 224 that extend generally perpendicularly from a first or top wall 210 and two spaced apart, in line "central areas" 225 of the bottom wall 212. As with the single building block 100, each partition 224 of each connector 222 of the double building block 200 preferably includes opposing, generally planar interior and exterior surfaces with a depression 230 on an exterior surface 228 thereof. Each depression 230 is sized and shaped generally identically to the depressions 130 on the connector 122 of the single blocks 100 to receive a projection 121 on a single building block 100 or a projection 221 preferably formed on an interior surface 216 of each of two (2) opposing longer side walls 214*a*, 214*b* of a double building block 200. Similar to the depression 130 of the single building block 100, the depressions 230 of the double building block 200 are preferably generally horizontally centrally located on the exterior surface 228 of each respective partition 224. Further, each projection 221 is preferably generally horizontally centrally located on the interior surface 216 of each of the two "blocks" 206 or one (1) inch segments of the front and rear side walls 214*a*, 214*b* proximal the bottom end 219. As depicted in FIGS. 11 and 12, the centerline spacing between the two projections 221 on each of the longer side walls 214*a*, 214*b* is essentially equal to the centerline spacing between the two connectors 222 on the top wall 211 and two central areas 225 of the bottom wall 212. As seen in FIGS. 10 and 12, the recessed area 223 of the double building block 200 surrounding the two central areas 225 is roughly twice the area of the single block recess 123 and in place of overlapping sidewalls (like 114*c*, 114*d*) includes generally opposing ribs 223*a*, 223*b* that extend generally perpendicularly from an interior surface 216 of the front and rear side walls 214*a*, 214*b*. As seen in FIG. 12, the ribs 223*a*, 223*b* are preferably slightly off-set from the vertical transverse plane 204 that bisects the double building block 200 and each of its four longer walls 210, 212, 214*a*, 214*b* to define the two adjoining "blocks" 206 of the double building block 200 (FIGS. 11 and 12). The off-set allows each rib 223*a*, 223*b* to frictionally engage at least portions of the faces of all four partitions 224 of a separate one of the two (2) connectors 222 when the double building block 200 is being stacked onto another double building block 200 or onto a multi-square building block 300, 400, 500. Specifically, each rib 223*a*, 223*b* is located on an opposing side of the respective plane 204.

The interference engagement of the full lengths of two opposing pairs of projections 221 (identical to projections 121) on the interior surfaces of the longer sidewalls 214*a*, 214*b* in two opposing pairs of depressions 230 (identical to depressions 130) is the mechanical equivalent of twice the interference engagements of two single blocks 100. Hereinafter this mechanical interference engagement between two double blocks 200 will be referred to as "two engagements" meaning the equivalent of two of the single building block 100 mechanical interference engagements. While the mechanical engagements between two fully engaged double building blocks 200 is generally twice or double the mechanical engagement of two fully engaged single building blocks 100, an important aspect of the present invention, as will be seen, is that all of the possible couplings between triple, quadruple and/or quintuple building blocks 300, 400, 500 will provide less than three engagements, meaning less than the full mechanical interference engagement provided by three opposing pairs of the projections 121 with three opposing pairs of the depressions 130.

Figure 25:
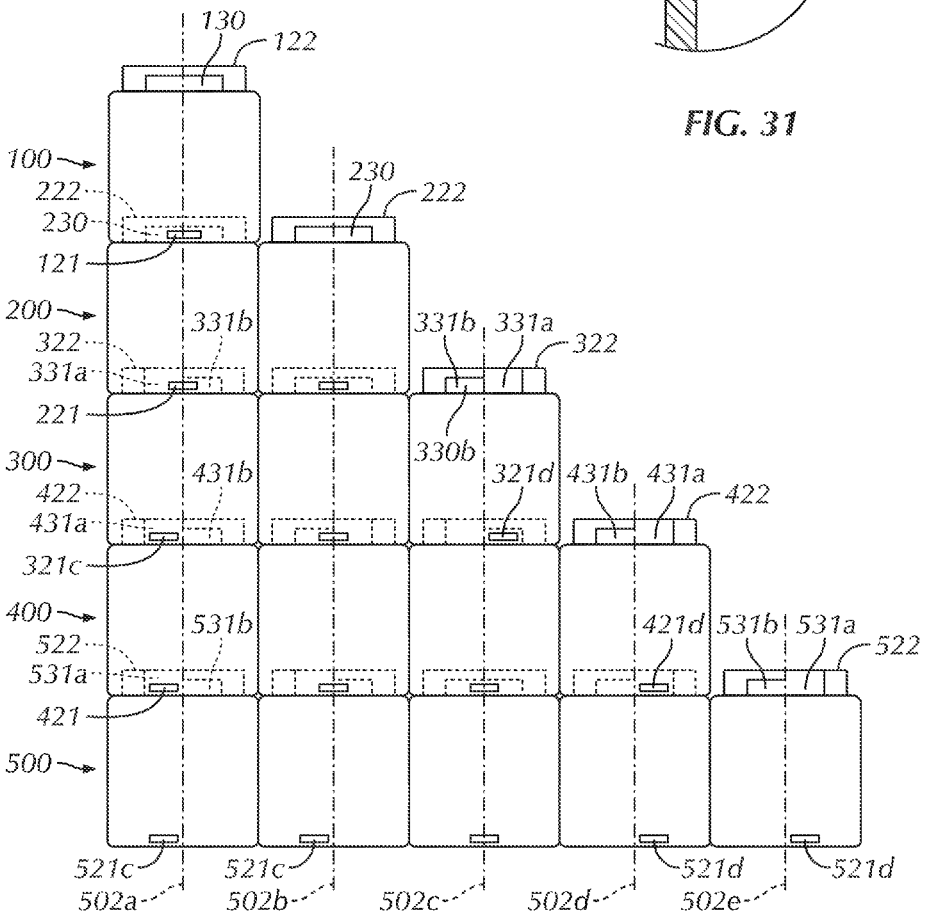
FIG. 25 is an elevation view of one exemplary configuration of the building blocks, wherein certain features are shown in phantom and other features are shown shaded for clarity and ease of illustration.

In operation, the engagement(s) and resulting attachment/detachment force(s) of two (2) stacked double building blocks 200 is approximately two full (2) engagements and/or force units. Specifically, since each double building block 200 includes the two (2) spaced-apart connectors 222 each with four (4) depressions 230 (one on each partition 224) equal in length and depth to depressions 130 and the recessed area 223 that is sized and shaped to receivingly engage each of the two connectors 222 with a total of four projections 221 each identical in length and height to one of the projections 121, the attachment/detachment forces generated by the interference between two, fully engaged, identical double building blocks 200 is generally twice that of two fully engaged, identical single building blocks 100. It will be appreciated that the frictional forces generated may not be equal to two single building blocks 100 because the ribs 223*a*, 223*b* do not contact the full length of any partition 124, 224. Further, as seen in FIG. 25, the attachment/detachment force between a fully engaged single building block 100 and a double building block 200 is indicated to be approximately one (1) force unit, since only one connector 222 or the recessed area 223 of the double building block 200 engages a recessed area 123 or connector 122, respectively, of the single building block 100. Only a single block (interference) engagement is provided between the single and double building blocks 100, 200.

Figure 14:
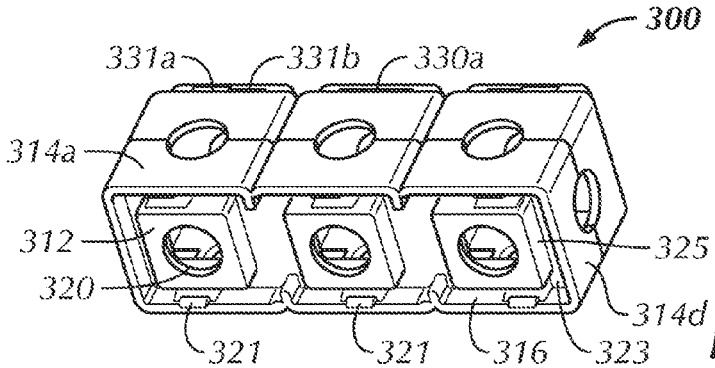
FIG. 14 is a bottom perspective view of the triple or three square building block shown in FIG. 13.
Figure 15:
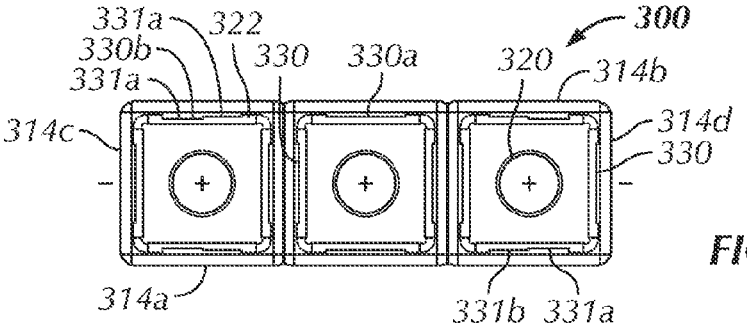
FIG. 15 is a top plan view of the triple or three square building block shown in FIGS. 13-14.
Figure 16:
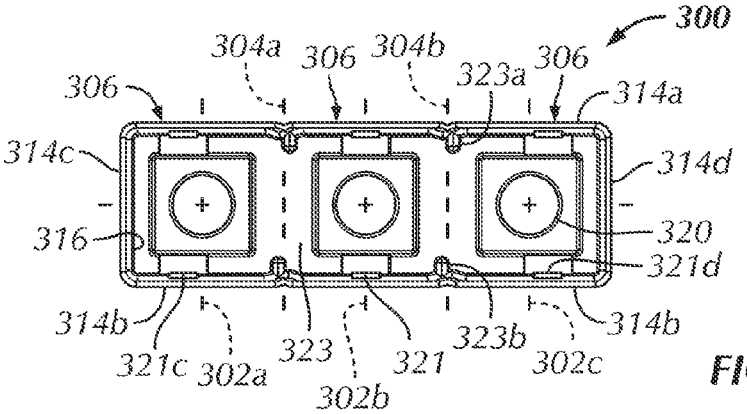
FIG. 16 is a bottom plan view of the triple or three square building block shown in FIGS. 13-15.

Referring to FIGS. 13-16, the triple building block 300 is substantially similar to the single and double building blocks 100, 200 described above. The triple building block 300 is essentially three (3) single building "blocks" 306 fixedly attached in a side-by-side configuration preferably with what would have been the equivalent of interior side walls eliminated. "Blocks" 306 are separated from one another by spaced-apart, generally parallel vertical transverse planes 304*a*, 304*b* (FIG. 16). Thus, a primary difference is that the top and bottom walls 310, 312 and a generally planar front (first) side wall 314*a* and an opposing generally planar rear (second) side wall 314*b* of the triple building block 300 are longer, generally three (3) times the length of a shorter, generally planar left (third) side wall 314*c* and an opposing generally planar right (fourth) side wall 314*d*. Specifically, the top, bottom, front and rear side walls 310, 312, 314*a*, 314*b* are rectangular and approximately three (3) inches in length and the left and right side walls 314*c*, 314*d* are approximately square and one (1) inch in length. In the preferred embodiment, the top, bottom, front and rear side walls 310, 312, 314*a*, 314*b* include three (3) uniformly spaced-apart openings 320 therein, while the left and right side walls 310, 312, 314*c*, 314*d* include a single centered opening 320 therein.

Figure 13:
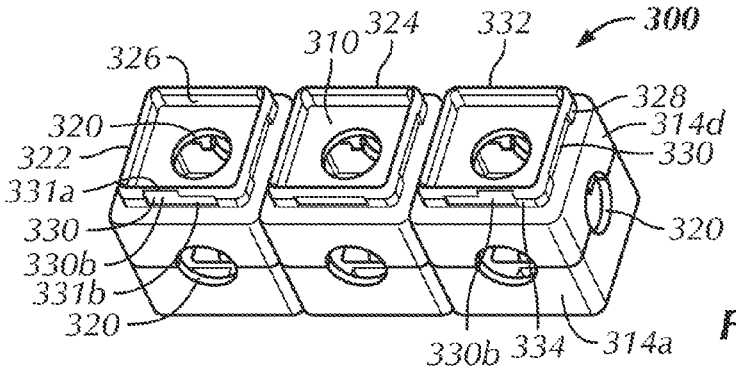
FIG. 13 is a top perspective view of a triple or three square building block (i.e., 1×3 block) in accordance with a preferred embodiment of the present invention.

Another difference is that the triple building block 300 includes three (3) uniformly spaced-apart, in line connectors 322 (i.e., left, middle/center and right), each extending generally perpendicularly away from a first or top wall 310 thereof and three central areas 325 of the bottom wall 312 surrounded by a continuous recessed portion 323. As with the single and double building blocks 100, 200, in the preferred embodiment each connector 322 of the triple building block 300 preferably includes four (4) partitions 324, wherein each partition 324 includes a depression 330 on an exterior surface 328 thereof that is sized and shaped to receive a projection 321 formed on an interior surface 316 of the two (2) opposing longer side walls 314*a*, 314*b*. Like the single and double building blocks 100, 200, the depression(s) 330 of the triple building block 300 are generally horizontally centrally located on the exterior surface 328 of the respective partition 324 proximal the block top wall 310. However, certain depressions 330 of the triple building block 300 preferably include at least a portion that extends upwardly to the first or free end 332 of the respective partition 324 distal to the top wall 310. Specifically, as seen in FIGS. 13, 15 and 25, the left-most and right-most depressions 330*b* formed on the partitions 324 that correspond to the front and rear side walls 314*a*, 314*b* include a first portion or half 331*a*, which extends through and from the first end 332 to the proximal the second end 334 of the partition 324, and a side-by side adjacent second portion or half 331*b*, which, as depicted, begins a predetermined, non-zero distance below the first end 332 and extends to proximal the second end 334 and is similar to one half of the depression 130 of the single building block 100. The middle depressions 330*a* formed on the front and rear partitions 324 of the middle connector 322, and that face outward from the front and rear side walls 314*a*, 314*b*, are identical to the depressions 130 of the single building block 100 as are depressions 330 on each of the partitions 324 of each of the connectors 322 that parallel left and right (third and fourth) shorter side walls 314*c* 314*d* (see FIG. 15).

Further, unlike the single and double building blocks 100, 200, at least one projection 321 of the triple building block 300 is not horizontally centrally located on an interior surface 316 of each of the three "blocks" 306 or one (1) inch segments of the front and rear sidewalls 314*a*, 314*b*. Specifically, as seen in FIGS. 14 and 16, certain projections 321 are preferably generally staggered or off-set when viewing the triple building block 300 from below (FIG. 16). A left-most projection 321*c* is located on a left side of a transverse vertical plane 302*a* that bisects the left-most opening 320 and "block" 306. A middle projection 321 is generally horizontally centrally located on the middle "block" 306 or middle one (1) inch segment of the front and rear side walls 314*a*, 314*b*. A right-most projection 321*d* is located on a right side of a vertical transverse plane 302*c* that bisects the right-most opening 320 and "block" 306.

Finally, as seen in FIGS. 14 and 16, another difference is that the recessed area 323 of the triple building block 300 that surrounds three uniformly spaced apart central areas 325 preferably includes two (2) pair of generally opposing ribs 323*a*, 323*b*. Again, ribs 323*a*, 323*b* extend generally perpendicularly from an interior surface 316 of the front and rear side walls 314*a*, 314*b*. Each pair of laterally opposing ribs 323*a*, 323*b* again is preferably slightly off-set from two (2) generally parallel, spaced-apart, vertical transverse planes 304*a*, 304*b*, that divide the triple building block 300 into three (3) equal "blocks" 306 (see FIG. 16) to engage portions of the connectors 322 when the triple building block 300 is being stacked onto another building block of the set 600. Specifically, one rib 323*a*, 323*b* of each pair is located on an opposing side of each respective plane 304*a*, 304*b*.

In operation, the maximum number of engagements and the approximate attachment/detachment force(s) of two (2) triple building blocks 300 stacked one atop the other with three (3) connectors 322 received in the received area 323 is less than three (3) times the number of engagements and force units provided to attach/detach two (2) single building blocks 100 and, more specifically, is preferably no greater than approximately only one and one-half (3/2) force units and engagements for the preferred triple building blocks 300 disclosed. For example, when the left side walls 314*c* are aligned, the left-most and right-most projections 321*c*, 321*d* of a first triple building block 300 align with the first half 331*a* of the depressions 330 of the two (2) outside "blocks" 306 of another triple building block 300. Thus, no mechanical interferences and no or only negligible attachment/detachment forces are provided by the left-most and right-most projections 321*c*, 321*d* in this configuration. There is only one (1) full mechanical interference engagement between the projections 321 and depressions 330*a* of the center "blocks" 306 and the total resulting attachment/detachment force is generally equal to one (1) force unit again from the connection of the middle projections 321 with the middle depressions 330*a*. When a first triple building block 300 is stacked on top of, but off-set from, a second triple building block 300, such that, for example, the left-most "block" 306 of the first triple building block 300 is directly vertically above the middle "block" 306 of the second triple building block 300, the number of resulting engagements is one and one-half (3/2) and the total resulting engagement force is approximately one and one-half (3/2) force units.

Further, as seen in FIG. 25, the engagement(s) and resulting attachment/detachment force(s) of a double building block 200 placed on top of a triple building block 300, wherein the left side walls 214*c*, 314*c* are vertically aligned, is preferably approximately one and one-half (3/2) engagements providing approximately one and one-half (3/2) force units. Only half (1/2) of the one projection 221 of the double building block 200 engages the second half 331*b* of the depression 330*b* of an end-most "block" 306 of the triple building block 300 and the entire remaining projection 221 of the double building block 200 engages the entire depression 330*a* of the middle "block" 306 of the triple building block 300. In light of the above-description, one of ordinary skill in the art would understand that the engagement of a triple building block 300 placed on top of a double building block 200 provides two (2) engagements with attachment/detachment force(s) of approximately two (2) force units.

As a matter of convention in describing the projections of the triple and longer building blocks 300, 400, 500 of set 600, centrally located projections 321 like those on center "block" 306 will be identified without postscripts while off-set projections 321 will be denoted with subscripts "c" or "d" indicating their proximity to either the left (third) side wall 314*c* or right (fourth) side wall 314*d*, respectively.

Referring to FIGS. 17-20, the quadruple building block 400 is substantially similar to the single, double and triple building blocks 100, 200, 300 described above. The quadruple building block 400 is essentially the equivalent of four (4) single "blocks" 406 fixedly attached in a side-by-side configuration and "separated" from one another by three uniformly spaced, parallel, vertical transverse planes 404*a*, 404*b*, 404*c*, (see FIG. 20). In addition, parallel, uniformly spaced apart vertical planes 402*a*, 402*b*, 402*c*, 402*d* bisect each "block" 406 and its respective opening 420.

Thus, a primary difference is that a top wall 410, a bottom wall 412, a generally planar front (first) side wall 414*a* and an opposing generally planar rear (second) side wall 414*b* of the quadruple building block 400 are longer, generally four (4) times the length of a shorter, generally planar left (third) side wall 414*c* and an opposing generally planar right (fourth) side wall 414*d*. Preferably, the top, bottom, front and rear side walls 410, 412, 414*a*, 414*b* are approximately four (4) inches in length and the left and right side walls 414*c*, 414*d* are approximately one (1) inch in length. In the preferred embodiment, the top, bottom, front and rear side walls 410, 412, 414*a*, 414*b* include four (4) uniformly spaced-apart openings 420 therein, while the left and right side walls 414*c*, 414*d* include a single opening 420 centered therein.

Figure 17:
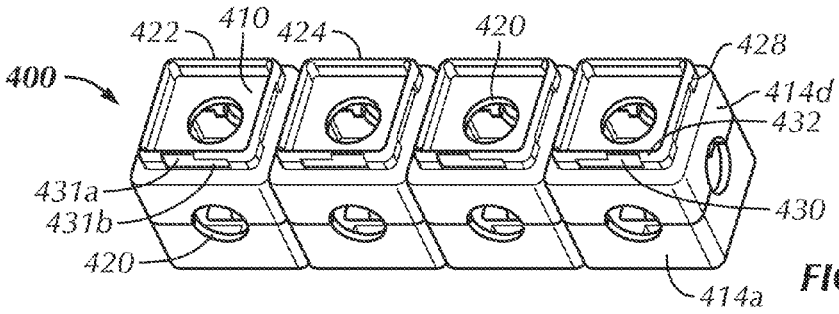
FIG. 17 is a top perspective view of a quadruple or four square building block (i.e., 1×4 block) in accordance with a preferred embodiment of the present invention.
Figure 19:
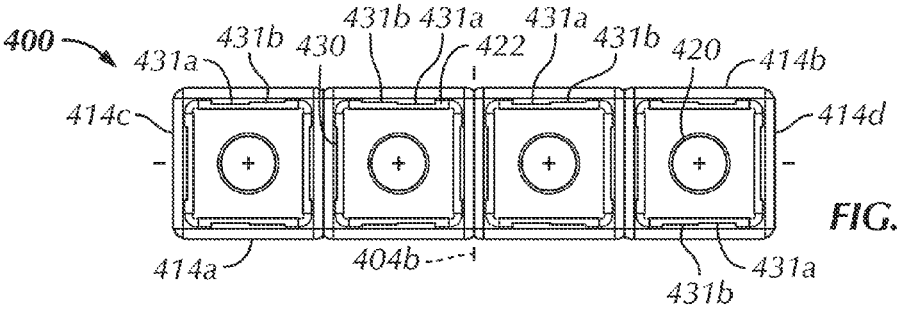
FIG. 19 is a top plan view of the quadruple or four square building block shown in FIGS. 17-18.

Another difference is that the quadruple building block 400 includes four (4) spaced-apart connectors 422 (i.e., left-most, left-middle, right-middle and right-most), each extending generally perpendicularly away from a first or top wall 410 thereof. As with the single, double and triple building blocks 100, 200, 300, in the preferred embodiment, each connector 422 of the quadruple building block 400 preferably includes four (4) partitions 424, wherein each partition 424 includes a depression 430 on an exterior surface 428 thereof that is sized and shaped to receive a projection 421 formed on an interior surface 416 of two (2) opposing side walls 414*a*, 414*b*. Like the single and double building blocks 100, 200, the depression(s) 430 of the quadruple building block 400 are generally horizontally centrally located on the exterior surface 428 of the respective partition 424. However, like the triple building block 300, at least one depression 430 of the quadruple building block 400 preferably includes at least a portion 431*a* that extends upwardly to the first free end 432 of the respective partition 424 and a portion 431*b* that does not. Specifically, as seen in FIGS. 17, 19 and 25, all of the depressions 430 formed on the partitions 424 that correspond to (or face outward with) the front and rear side walls 414*a*, 414*b* include a first half 431*a*, which extends from the first end 432 to the second end 434, and an adjacent second half 431*b*, which is positioned a predetermined distance below the first end 432 and is similar to the depression 130 of the single building block 100. As seen in FIGS. 17, 19 and 25, the location of the first and second halves 431*a*, 431*b* of each adjacent depression 430 is flipped or reversed. For example, in the depression 430 of the left-most "block" 406 defining the left side wall 414*c*, the first half 431*a* is located on the left side of the second half 431*b* and proximal side wall 414*c*. In the depression 430 of the left-middle "block" 406, the first half 431*a* is located on the right side of the second half 431*b* proximal the bisecting vertical transverse plane 404*b*.

Figure 18:
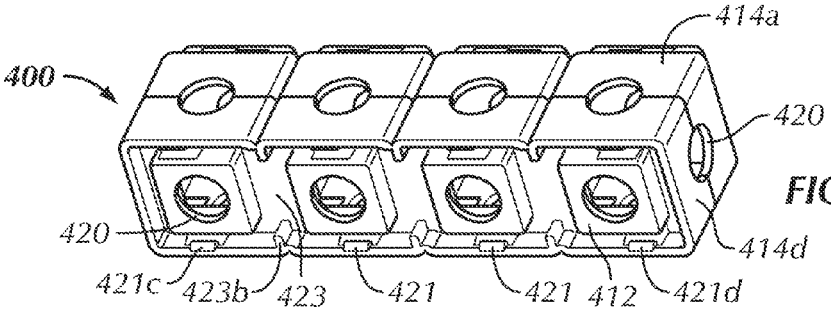
FIG. 18 is a bottom perspective view of the quadruple or four square building block shown in FIG. 17.
Figure 20:
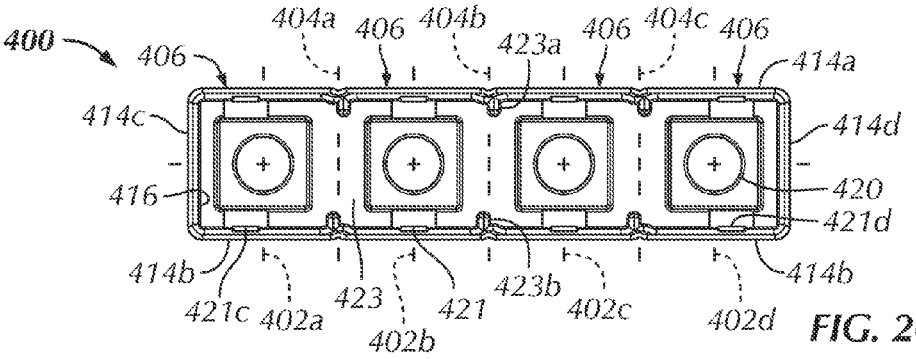
FIG. 20 is a bottom plan view of the quadruple or four square building block shown in FIGS. 17-19.

Further, like triple building block 300, at least one of the projections 421 of the quadruple building block 400 is preferably not horizontally centrally located on an interior surface 416 of a "block" portion 406 of certain side walls 414. Specifically, as seen in FIGS. 18 and 20, certain projections 421 are preferably generally staggered or off-set, such that when viewing the quadruple building block 400 from below (FIG. 20), a left-most projection 421*c* is located on a left side of the transverse vertical plane 402*a* that bisects the left-most "block" 406 and its opening 420 and a right-most projection 421*d* is located on a right side of the transverse vertical plane 402*d* that bisects the right-most opening "block" 406 and its opening 420. The left-middle and right-middle projections 421 are generally horizontally centrally located on the left-middle and right-middle "block" 406, respectively, of the quadruple building block 400 and are bisected by transverse vertical planes 402*b*, 402*c*, respectively.

As seen in FIGS. 18 and 20, the recessed area 423 of the quadruple building block 400 preferably includes three (3) pair of generally opposing ribs 423*a*, 423*b* that extend generally perpendicularly from an interior surface 416 of the front and rear side walls 414*a*, 414*b*. Each pair of laterally opposing ribs 423*a*, 423*b* is preferably slightly off-set from one of the three (3) transverse vertical planes 404*a*, 404*b*, 404*c* to engage portions of the connector(s) 422 when the quadruple building block 400 is being stacked onto another building block of the set 600. Specifically, one rib 423*a*, 423*b* of each pair is located on an opposing side of the respective plane 404*a*, 404*b*, 404*c*, with rib 423*a* on the right side and rib 423*b* on the left side.

In operation, the maximum number of engagements and the approximate attachment/detachment force(s) of two (2) quadruple building blocks 400 stacked one atop the other with all four (4) connectors 422 received in the recessed area 423 is less than four (4) times and less than even three (3) times the number of engagements provided by and the number of force units required to attach/detach two (2) single building blocks 100. More specifically, the number of engagements and the resulting attachment/detachment force units are no more than approximately only two (2), or twice the number of engagements and attachment/detachment force units of one pair of stacked square blocks 100. In particular, when the left-side walls 414*c* are vertically aligned, the left-most and right-most projections 421*c*, 421*d* of a first quadruple building block 400 align with the first half 431*a* of the depressions 430 of the two (2) outside (i.e., left-most and right-most) "blocks" 406 of another quadruple building block 400. Thus, the left-most and right-most projections 421*c*, 421*d* provide no mechanical interference engagement and only negligible attachment or detachment forces. Only one-half (½) of a mechanical engagement and a resultant force unit is provided by the left half (when viewed from below in FIG. 20) of the left-middle projection 421 of the first quadruple building block 400 contacting and interferingly engaging with the second half 431*b* of the left-middle depression 430 of the second quadruple building block 400. Another one-half (½) mechanical engagement and resultant force unit is provided by the right half (when viewed from below in FIG. 20) of the right-middle projection 421 of the first quadruple building block 400 contacting and interferingly engaging with the second half 431*b* of the right-middle depression 430 of the second quadruple building block 400. Thus, when the left-side walls 414*c* are vertically aligned, the total resulting attachment/detachment force is approximately one (1) force unit provided by two (2) one-half (½) mechanical engagements. When a first quadruple building block 400 is stacked on top of, but off-set from a second quadruple building block 400, such that the left-most "block" 406 of the first quadruple building block 400 is directly vertically above the left-middle "block" 406 of the quadruple building block 400, the total resulting engagement force is no more than about two (2) force units provided by two (2) half (½) mechanical interference engagements plus one (1) full mechanical interference engagement.

Further, as seen in FIG. 25, with a triple building block 300 placed on top of a quadruple building block 400 (left side walls 314*c*, 414*c* being vertically aligned) and three of the connectors 422 received in recessed area 323, one and one-half (3/2) mechanical engagements are formed which provide the equivalent of approximately one and one-half (3/2) force units. Specifically, with left side walls 314*c*, 414*c* aligned, the left projection 321*c* of the triple building block 300 does not engage the second half 431*b* of the depression 430 of the left-most "block" of the quadruple building block 400, resulting in no mechanical engagement and no force or only a negligible force. Only a left half (when viewing the triple building block 300 from below—FIG. 16) of the middle projection 321 of the triple building block 300 engages the second half 431*b* of the depression 430 of the left-middle "block" of the quadruple building block 400, resulting in one-half (½) of a mechanical engagement providing approximately one-half (½) of a force unit. Finally, the entire right projection 321*d* of the triple building block 300 engages the second half 431*b* of the depression 430 of the right-middle "block" of the quadruple building block 400, resulting in one (1) full mechanical engagement providing one (1) force unit. Thus, the total resulting number of mechanical engagements and the approximate attachment/detachment force units is one and one-half (3/2). A mirror image set of engagements and force units are generated with the right side walls 314*d*, 414*d* aligned. In light of the above-description, one of ordinary skill in the art would understand that a quadruple building block 400 placed on top of a triple building block 300 with all three connectors 322 received in recessed area 423 results in the equivalent of one and one-half (3/2) mechanical engagements providing approximately one and one-half (3/2) force units.

Referring to FIGS. 21-24, the quintuple building block 500 is substantially similar to the blocks 100, 200, 300, 400 described above. The quintuple building block 500 is essentially equivalent to five (5) single building "blocks" 506 fixedly attached in a side-by-side configuration and separated from one another by uniformly spaced and generally parallel vertical transverse planes 504*a*, 504*b*, 504*c*, 504*d* (see FIG. 24). Parallel uniformly spaced-apart vertical transverse planes 502 bisect each "block" 506.

A primary difference is that a top wall 510, a bottom wall 512 at an opposing bottom end 519, a generally planar front (first) side wall 514*a* and an opposing generally planar rear (second) side wall 514*b* of the quintuple building block 500 are longer, generally five (5) times the length of a shorter, generally planar left (third) side wall 514*c* and an opposing generally planar right (fourth) side wall 514*d*. Specifically, the top, bottom, front and rear side walls 510, 512, 514*a*, 514*b* are preferably approximately five (5) inches in length and the left and right side walls 514*c*, 514*d* are preferably approximately one (1) inch in length (and height). In the preferred embodiment, each of the top, bottom, front and rear side walls 510, 512, 514*a*, 514*b* include five (5) uniformly spaced-apart openings 520 therein, while the left and right side walls 514*c*, 514*d* include a single centered opening 520 therein.

Another difference is that the quintuple building block 500 includes five (5) spaced-apart connectors 522 (i.e., left-most, left-middle, middle, right-middle and right-most), each extending generally perpendicularly away from the first or top wall 510 thereof and five spaced apart central portions 525 of the bottom wall 512 surrounded by a recessed portion 523 of the bottom wall 512 at the bottom end 519 of the block 500. As with the previously-described building blocks 100, 200, 300, 400, in the preferred embodiment each connector 522 of the quintuple building block 500 preferably includes four (4) partitions 524, wherein each partition 524 includes a depression 530 on an exterior surface 528 thereof that is sized and shaped to receive a projection 521 formed on an interior surface 516 of two (2) opposing side walls 514*a*, 514*b*. Like the previously-described building blocks 100, 200, 300, 400, the depression(s) 530 of the quintuple building block 500 are preferably generally horizontally centrally located on the exterior surface 528 of the respective partition 524.

Figure 21:
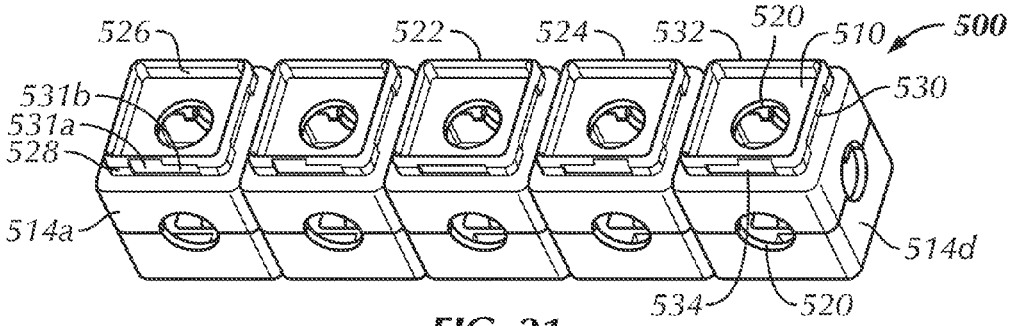
FIG. 21 is a top perspective view of a quintuple or five square building block (i.e., 1×5 block) in accordance with a preferred embodiment of the present invention.
Figure 23:
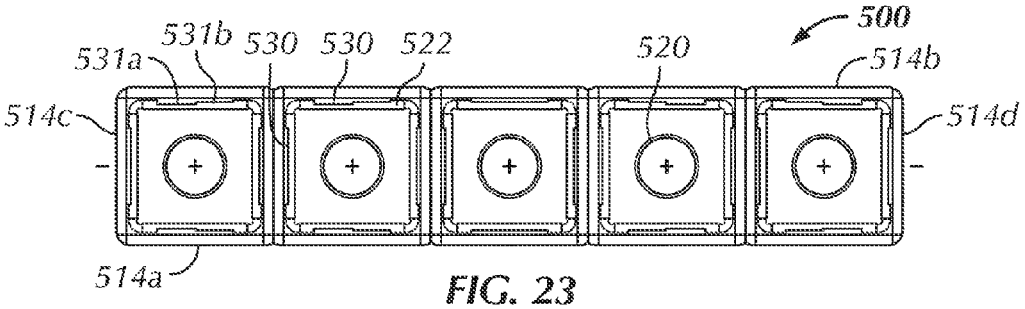
FIG. 23 is a top plan view of the quintuple or five square building block shown in FIGS. 21-22.

However, like the triple and quadruple building blocks 300, 400, at least one depression 530 of the quintuple building block 500 preferably includes at least a portion that extends upwardly to the first or free end 532 of the respective partition 524. Specifically, as seen in FIGS. 21, 23 and 25, each of the outermost four (4) of the depressions 530 formed on the partitions 524 that correspond to the front and rear side walls 514*a*, 514*b* includes a first half 531*a*, which extends from the first end 532 to the second end 534, and an adjacent second half 531*b*, which is positioned a predetermined distance below the first end 532 and is similar to the depression 130 of the single block 100. As seen in FIGS. 21, 23 and 25, the location of the first and second halves 531*a*, 531*b* of the depressions 530 on an outside adjoining pair (i.e., left-most and left-middle) of "blocks" 506 of the quintuple building block 500 is flipped or reverse to the location of the first and second halves 531*a*, 531*b* of the depressions 530 on the opposite outside adjoining pair (i.e., right-middle and right-most) of "blocks" 506. For example, in the depressions 530 of the left-most and left middle "blocks" 506 (see FIG. 23), the first half 531*a* is located on the left side of the second half 531*b* where half 531*a* is more proximal left side wall 514*c*. In the depressions 530 of the right-most and right-middle "blocks" 506, the first half 531*a* is located on the right side of the second half 531*b* where half 531*a* is more proximal right side wall 514*d*.

Figure 24:
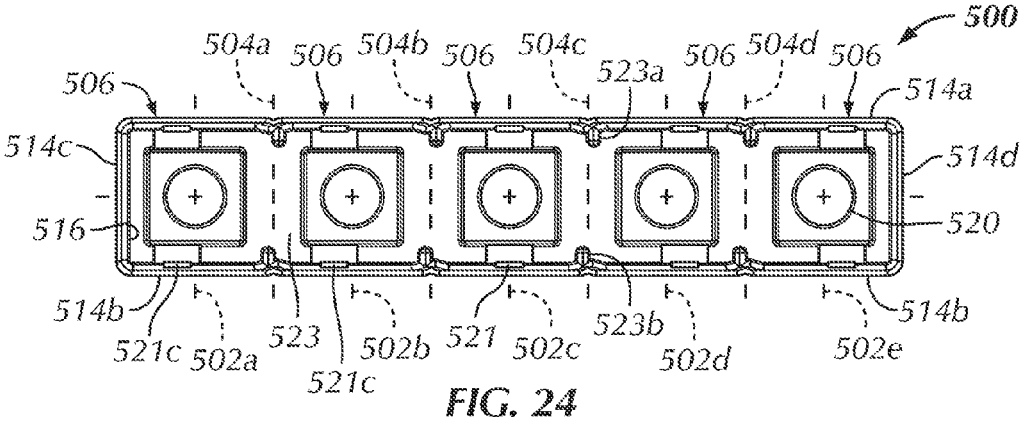
FIG. 24 is a bottom plan view of the quintuple or five square building block shown in FIGS. 21-23.

Further, like triple and quadruple building blocks 300, 400, at least one of the projections 521 of the quintuple building block 500 is not horizontally centrally located on an interior surface 516 of certain side walls 514. Specifically, as seen in FIGS. 20, 24 and 25, certain projections 521*c*, 521*d* are preferably generally staggered or off-set, such that when viewing the of the quintuple building block 500 from below (FIG. 24), each of the left-most and left-middle projections 521*c* are located on a left side of transverse vertical planes 502*a*, 502*b* that further bisect the left-most and left-middle openings 520. Each of the right-most and right-middle projections 521*d* are located on a right side of transverse vertical planes 502*e*, 502*d* that further bisect the right-most and right-middle openings 520. The middle projection 521 is generally horizontally centrally located on the middle "block" 506.

Figure 22:
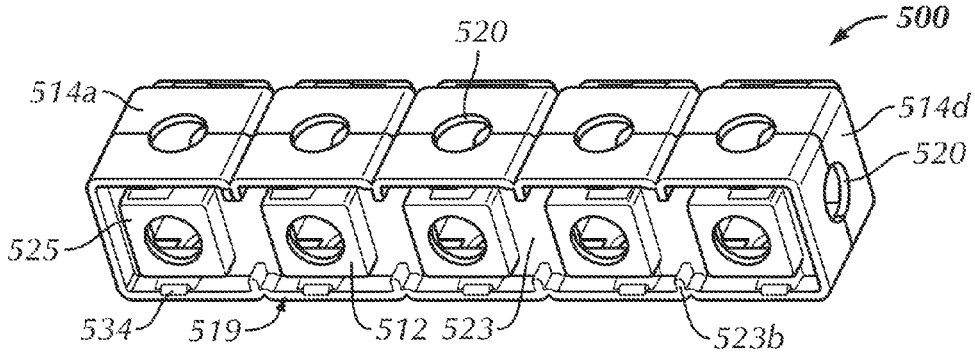
FIG. 22 is a bottom perspective view of the quintuple or five square building block shown in FIG. 21.

As seen in FIGS. 22 and 24, the recessed area 523 of the quintuple building block 500 preferably includes four (4) pair of generally opposing ribs 523*a*, 523*b* that extend generally perpendicularly from an interior surface 516 of the front and rear side walls 514*a*, 514*b*. Each pair of laterally opposing ribs 523*a*, 523*b* is preferably slightly off-set from one of the four (4) vertical transverse planes 504*a*-504*d*, uniformly spaced apart from one another and side walls 514*c* and 514*d*, which they parallel, that divide the quintuple building block 500 into five (5) equal "blocks" 506 to engage at least portions of all of the partitions received in the recessed area 523 when the quintuple building block 500 is stacked onto another building block of the set 600. Specifically, one rib 523*a*, 523*b* of each pair is located on an opposing side of the respective plane 504*a*-504*d*, with rib 523*b* to the left and 523*a* to the right.

In operation, the maximum number of engagements and the approximate attachment/detachment force(s) of two (2) of the preferred quintuple building blocks 500 stacked one atop the other with all five (5) connectors 522 received in the recessed area 523 (e.g., left side walls 514*c* vertically aligned) is less than five (5) and even less than three (3) times the number of engagements and the force units required to attach/detach two (2) single building blocks 100. More specifically, the two stacked quintuple blocks 500 disclosed provide only one (1) full mechanical engagement with approximately one (1) force unit. Specifically, the left-most and left-middle projections 521*c* and the right-middle and right-most projections 521*d* of a first quintuple building block 500 align with the first half 531*a* of the depressions 530 of the two (2) outside pairs (i.e., left-most left-middle, right-middle and right-most) of "blocks" 506 of another quintuple building block 500 and provide no equivalent mechanical engagement and no or only a negligible force unit. The one (1) force unit or engagement that is provided is the result of all of the middle depression 530 engaging all of the middle projection 521.

However, it should further be appreciated that in the preferred embodiment, the maximum number of engagements and force units that are possible to provide between two quintuple building blocks 500 offset stacked one atop the other is approximately two and one-half (5/2). Specifically, when the left-most "block" 506 of a first quintuple building block 500 is vertically aligned with the middle "block" 506 of the second quintuple building block 500 and the blocks 500 are engaged, the left-most projection 521*c* fully engages the middle depression 530 of the second quintuple building block 500 providing one (1) full engagement resulting in one (1) force unit. Further, the entire left-middle projection 521*c* of the first (upper) quintuple building block 500 engages the second half 531*b* of the right-middle depression 530 of the second quintuple building block 500 resulting in another full engagement providing approximately one (1) force unit. Further, the left half of the middle projection 521 of the first quintuple building block 500 engages the second half 531*b* of the right-most depression 530 of the second quintuple building block 500 resulting in one-half (½) engagement providing approximately one-half (½) force unit. Thus, the total resulting number of engagements and approximate number of force units provided are no more than about two and one-half (5/2).

As seen in FIG. 25, the number of engagements and resulting approximate attachment/detachment force units of a preferred quadruple building block 400 placed on top of a preferred quintuple building block 500 (left side walls 414*c*, 514*c* being vertically aligned) is only one and one-half (3/2). Specifically, with the left walls 414*c*, 514*c* aligned, the left-most and right-most projections 421*c*, 421*d* of the quadruple building block 400 do not engage the second half 531*b* of the depression 530 of the left-most and right-middle "blocks" 506 of the quintuple building block 500, resulting in no mechanical engagements and no or only a negligible attachment/detachment force. A right half (when viewing the quadruple block 400 from below—FIG. 20) of the left-middle projection 421*c* of the quadruple building block 400 engages the second half 531*b* of the depression 530 of the left-middle "block" of the quintuple building block 500 to provide one-half (½) of a mechanical engagement resulting in approximately one-half (½) force unit. Further, one (1) engagement and force unit results from the interference of all of the right-middle projection 421*d* of the quadruple building block 400 with the middle depression 530 of the quintuple building block 500. Thus, the total number of engagements and approximate resulting attachment/detachment force units is one and one-half (3/2). A mirror image set of engagements and force units are generated with the right side walls 414*d*, 515*d* aligned. In light of the above-description, one of ordinary skill in the art would understand that the maximum number of attachment/detachment force(s) units or mechanical engagement(s) of a quintuple building block 500 placed on top of a quadruple building block 400 is approximately one and one-half (3/2).

In light of all of the above, it is understood by those skilled in the art that a predetermined engagement force or force required to remove one rectilinear polyhedron block that is fully engaged with another polyhedron block, both of which have at least two side walls that are at least three times the length of the remaining two side walls, is less than three times a predetermined engagement force or force required to remove one cubic polyhedron block (i.e., a single square building block 100) that is fully engaged with another cubic polyhedron block (i.e., another single square building block 100). Likewise, an engagement force generated between two, identical, fully engaged, multi-square blocks (i.e., triple, quadruple or quintuple building blocks 300, 400, 500) is less than the integer multiple of the lengths of the identical, multi-square blocks (i.e., three, four or five) times the engagement force (i.e., one (1) force unit) generated between two, fully engaged, identical cubic blocks (i.e., two (2) single square building blocks 100).

Figure 27:
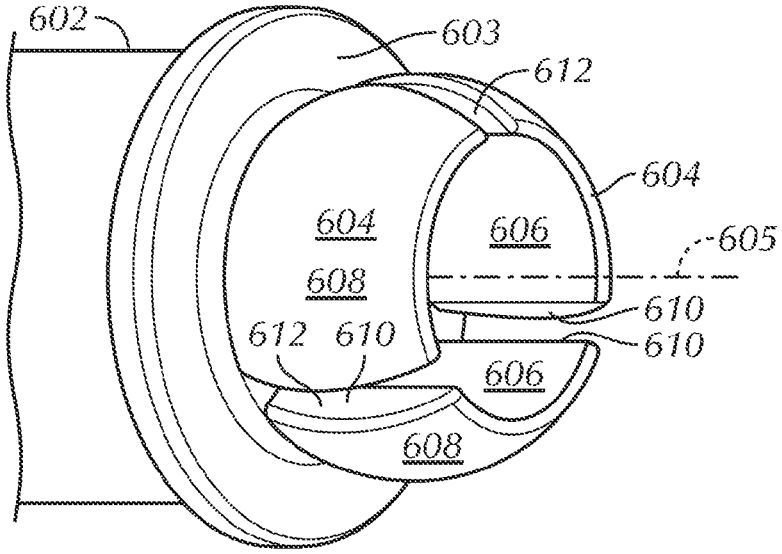
FIG. 27 is a perspective view of one end of a rod in accordance with an alternative preferred embodiment of the present invention from that shown in FIGS. 7 and 26.

Referring to FIG. 27, an alternative preferred embodiment of one end of a rod 602' includes a generally planar end wall 603. The end wall 603 defines a plane that extends generally perpendicular to a longitudinal axis 605 of the rod 602'. At least one but preferably three spaced-apart connecting tabs 604 extend from the end wall 603. Each tab 604 is preferably generally arcuate in shape when viewing the rod 602' perpendicular to its longitudinal axis 605. Specifically, an interior surface 606 of each tab 604 is preferably generally concavely shaped with respect to the longitudinal axis 605 of the rod 602 and an exterior surface 608 of each tab 604 is preferably generally convexly shaped with respect to the external environment of the rod 602. More particularly, the three tabs 604 define portions of a common imaginary truncated sphere and so share a common center and radius to their respective outer surfaces. Opposing side walls 610 of each tab 604 are generally spaced-apart by a gap or groove 612 having a uniform thickness, as measured along the longitudinal axis 605 of the rod 602'. The rod 602' and tabs 604 are preferably formed of a polymeric material, such as acrylonitrile butadiene styrene (ABS), which preferably produces an audible noise, such as a "click," when the end of the rod 602 is inserted into and/or removed from one of the openings 120, 220, 320, 420, 520 of one of the blocks 100, 200, 300, 400, 500. The present design of the end of the rod 602' minimizes insertion forces while maintaining relatively strong or solid construction of the set 600. When the end of the rod 602' is inserted into an opening 120, 220, 320, 420, 520, the rod 602' is relatively easily capable of rotating with respect to the opening 120, 220, 320, 420, 520 (about the longitudinal axis 605), but a predetermined greater force is required to remove the end of the rod 602' from the opening 120, 220, 320, 420, 520.

Figure 28:
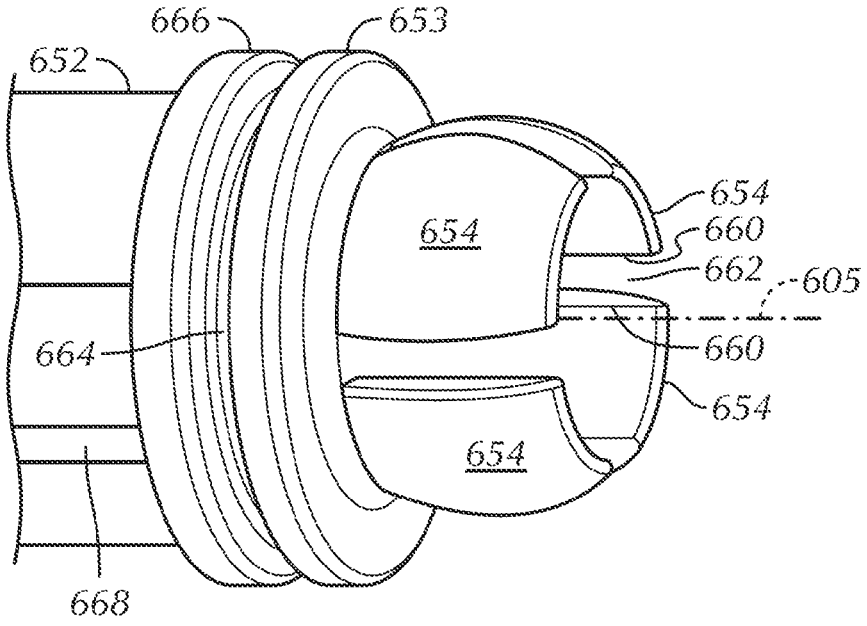
FIG. 28 is a perspective view of one end of a rod in accordance with another alternative preferred embodiment of the present invention from that shown in FIGS. 7 and 26.

Referring to FIG. 28, another alternative preferred embodiment of one end of a rod 652 is shown. The rod 652 of the second preferred embodiment is substantially similar to the rod 602' of the first preferred embodiment. However, the rod 652 of the second preferred embodiment includes preferably four spaced-apart connecting tabs 654 that extend from an end wall 653 of the rod 652. More particularly, the four tabs 654 define portions of a common imaginary truncated sphere and so share a common center and radius to their respective outer surfaces. Similar to the first preferred embodiment, opposing side walls 660 of each tab 654 are generally spaced-apart by a gap or groove 662 having a uniform thickness, as measured along a longitudinal axis 655 of the rod 652. Further, a recess 664 is located between the end wall 653 and a ridge 666. Specifically, the recess 664 and ridge 666 extend around the entire periphery or circumference of the rod 652. The combination of the end wall 653, recess 664 and ridge 666 may receivably engage a portion of one of the other components of the set, such as an opening 120, 220, 320, 420, 520 of one or more of the blocks 100, 200, 300, 400, 500. In addition, the rod 652 may include one or more channels 668 that extend from the outer periphery of the rod 652 toward a geometric center thereof and extend generally parallel to the longitudinal axis 655 of the rod 652. The one or more channels 668 may be sized and shaped to receivably engage a portion of one of the other components of the set 600.

Figure 29:
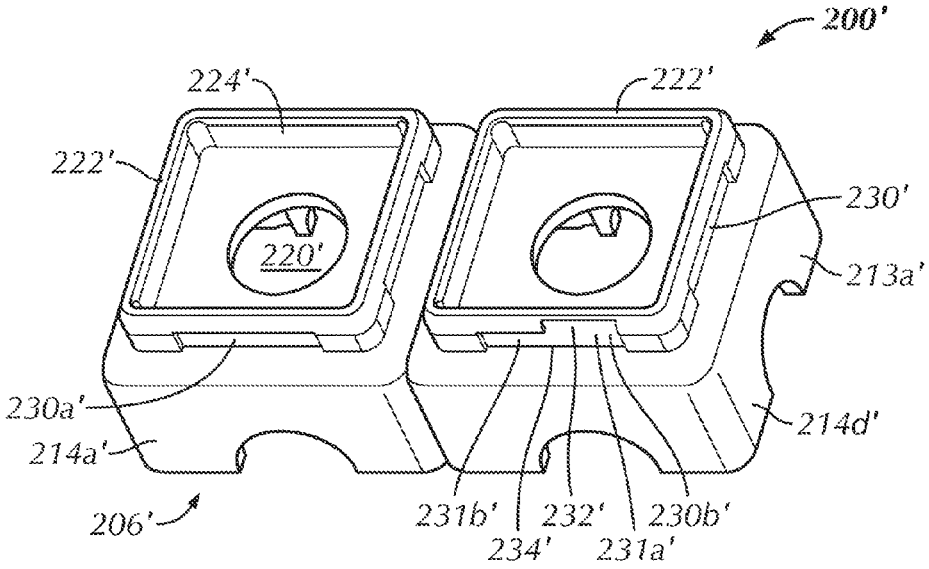
FIG. 29 is a top perspective view of a first portion of a double or two square building block (i.e., 1×2 block) in accordance with an alternative preferred embodiment from that shown in FIGS. 9-11.
Figure 30:
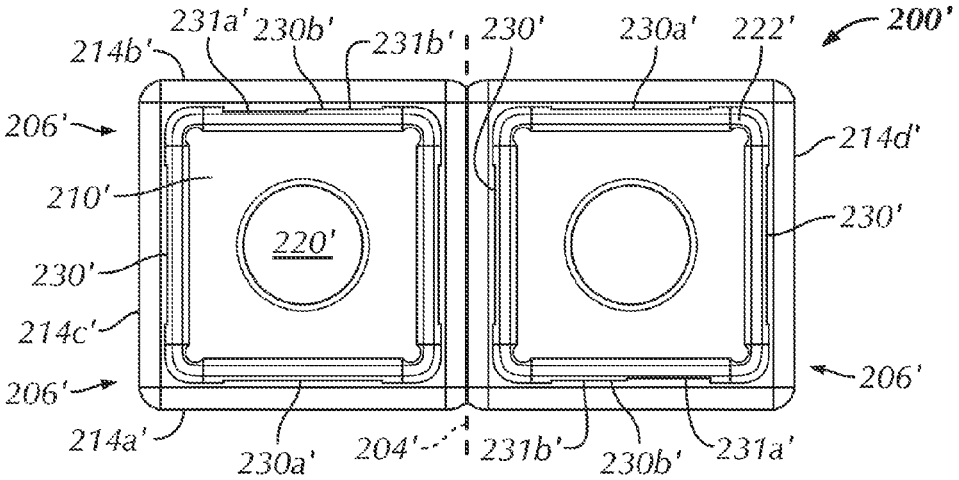
FIG. 30 is a top plan view of the first portion of the alternative preferred embodiment of the double or two square building block (i.e., 1×2 block) shown in FIG. 29.

Referring to FIGS. 29-30, in an alternative preferred embodiment double building block 200', like numerals are utilized to identify like elements and a prime symbol (') is utilized to distinguish like components of the preferred alternative double building block 200' from preferred double building block 200 shown in FIGS. 9-12. The alternative double building block 200' is substantially similar to the double building block 200 described above. A primary difference between the two embodiments is that at least one depression 230' of the alternative preferred embodiment preferably includes at least a portion that extends upwardly to the first or free end 232' of a respective partition 224' distal to a top wall 210', similar to the third building block 300. Preferably, one depression 230*b*' formed on the partitions 224' that correspond to front and rear side walls 214*a*', 214*b*' included a first half 231*a*', which extends from proximal a first end 232' to an opposite second end 234' of the partition 224', and an adjacent second half 231*b*', which is positioned a predetermined distance below the first end 232' and is similar to one-half of the depression 130 of the single building block 100. A second depression 230*a*' formed on the partitions 224' that correspond to the front and rear side walls 214*a*', 214*b*' are identical to the depressions 130 of the single building block 100 as are depressions 230' on each of the partitions 224' that parallel left and right (third and fourth) side walls 214*c*', 214*d*'. As seen in FIG. 30 and unlike the triple, quadruple and quintuple building blocks 300, 400, 500, the depressions 230*a*', 230*b*' that correspond to the front and rear side walls 214*a*', 214*b*' are not mirror images of each other, such that the depression 230*b*' on the rear side wall 214*b*' of the left "block" 206' has a different size and/or shape than the depression 230*a*' on the front side wall 214*a*' of the left "block" 206'. The second or lower portion of the alternative double building block 200' is identical to that described above for the double building block 200.

In operation, the maximum number of engagements and the approximate attachment/detachment force(s) of two (2) alternative double building blocks 200' stacked one atop the other with two (2) connectors 222' received in the recessed area 223 (see FIGS. 10 and 12) is less than two (2) times the number of engagements and force units provided to attach/detach two (2) single building blocks 100 and, more specifically, is preferably only one and one-half (3/2) engagements providing about one and one-half (3/2) force units for the alternative double building blocks 200' disclosed. For example, when the left side walls 214*c*' of two alternative double building blocks 200' are aligned, one projection 221 (see FIGS. 10 and 12) of a first alternative double building block 200' aligns with and engages the first half 231*b*' of the facing depression 230' of the one "block" 206' of another alternative double building block 200'. Likewise, an identical one-half (1/2) engagement occurs on the diagonally opposite face of the other "block" 206'. Thus, one-half (1/2) of a full mechanical interference engagement providing about a one-half (1/2) magnitude attachment/detachment force is provided by the engagement of diagonally opposite projections 221 (see FIGS. 10 and 12) and depressions 230*b*'. Further, one (1) full mechanical interference engagement providing about one (1) attachment/detachment force unit is the result of the engagement between remaining projections 221 (see FIGS. 10 and 12) and the full length depressions 230*a*' of the remaining diagonally opposite faces. Thus, a total of one and one-half (3/2) equivalent mechanical engagements provide a total resulting attachment/detachment force generally equal to one and one-half (3/2) force units. In light of the above description, one of ordinary skill in the art could easily calculate the various equivalent mechanical engagements and/or forces generated between the alternative double building block 200' and one or more of the remaining blocks 100, 200, 300, 400, 500.

It will be appreciated by those skilled in the art that changes could be made to the embodiments described above without departing from the broad inventive concept thereof. For example, the location of various projections and depressions can be reversed, such that a depression is formed on an interior surface of a side wall and a projection is formed on an exterior surface of a partition of one of the connectors. Also, the locations of the projections/depressions can be reversed so that depressions (or projections) might be on the interior surfaces of the partitions and connector(s) while projections (or depressions) might be located on opposite outwardly facing surfaces of the recessed area(s). It will further be appreciated that the projections and depressions of each described block 100-500 are mirror image symmetric with respect to the central vertical transverse plane that bisects the top, bottom, front and back walls of each block 100-500. Accordingly, positional changes of the various projections and depressions might be made on a block or the set of blocks, and even longer beams provided, as long as the symmetry to the central vertical bisecting plane is maintained. Furthermore, while the lengths and heights of all of the projections 121-521 were the same in the preferred embodiments 100-500, it should be appreciated that they might be varied to achieve the desired equivalent mechanical engagements and/or attachment/detachment forces and force units. Also, the mechanical engagements described utilize interference geometry to create frictional attachment/detachment forces. It should be appreciated that the engagements and resulting forces might be provided by directed contact between protrusions and planar or similarly uniform surfaces with depressions that would prevent direct contact. Finally, while square connectors and recesses that are disclosed are parallel to the side walls of the various blocks, it will be appreciated that the connectors and recessed areas might be rotated 45 degrees from their indicated positions without effect on function.

It will further be appreciated that instead of four partitions and equivalent shaped recessed areas, a greater number, preferably multiples of four partitions, might be provided, preferably also with similarly configured recessed areas, to increase the possible angle orientations available to transversely joined blocks. It will further be appreciated that instead of polynomial partitions and recessed areas, circular partitions and matching recessed areas may be provided with each divided into quadrants containing projections and depressions equivalent to those disclosed or suggest above.

Furthermore, other building set elements will be provided with the previously described engagements. The invention is not simply limited to rectangular polyhedron building blocks but further includes other building elements of other shapes and dimensions utilizing the above-described engagements.

It should be understood, therefore, that this invention is not limited to the particular embodiments disclosed, but it is intended to cover modifications within the spirit and scope of the present invention.

We claim:

1. A first rectilinear polyhedron toy building block comprising:

a top wall;

four side walls extending orthogonally away from the top wall to a bottom end of the block, each of the four side walls having an interior surface facing a geometric center of the block and an opposing exterior surface exposed outside of the block;

at least one connector extending away from the top wall in a direction opposite the four side walls, the at least one connector including a plurality of partitions, each partition having an interior surface facing a geometric center of the connector and an opposing exterior surface, a free end and an opposing end affixed with the top wall;

a bottom wall spaced apart from the top wall and extending across the bottom end of the block within the four side walls;

a projection extending away from the interior surface of at least one of the side walls proximal the bottom end or from the exterior surface of one of the plurality of partitions; and a depression formed within the exterior surface of at least one of the plurality of partitions or within the interior surface of one of the plurality of side walls proximal the bottom end such that the one of the side walls bears proximal the bottom end either the projection or the depression and the one of the partitions bears a remaining one of the projection or the depression with the depression of the first toy building block being located, sized and shaped to receive the projection of a second toy building block identical to the first toy building block so as to releasably join the first and second toy building blocks;

wherein the exterior surface of each of at least two of the plurality of partitions of the at least one connector extends perpendicular with respect to the top wall from the top wall and each of the at least two partitions includes a depression in the perpendicular exterior surface; and wherein the depressions formed in the exterior surfaces of the at least two partitions of the first toy block are different in shape from one another so as to engage with different strengths, one projection on a second toy building block identical to the first toy building block, the second toy building block being selectively orientable on the at least one connector of the first toy building block so as to releasably engage the one projection of the second toy building block with each of the differently shaped depressions.

2. The first toy building block according to claim 1 wherein the bottom wall is recessed from the bottom end sufficiently to receive at least one connector of a second toy building block identical to the first toy building block.

3. The first toy building block set according to claim 2 wherein the bottom wall of the first toy building block is recessed from the bottom end proximal each of the side walls of the first toy building block sufficiently to receive at least one connector of the second toy building block between the interiors of the side walls and a central portion of the bottom wall of the first toy building block spaced inwardly from each of the side walls.

4. The first toy building block according to claim 3 wherein the central portion of the bottom wall is sized to be received in a central opening formed by the interior surfaces of the partitions of the at least one connector of a second toy building block identical to the first toy building block.

5. The first toy building block according to claim 1 having four side walls of equal height from the top wall, two being opposing shorter side walls and two being opposing longer side walls, the longer side walls being approximately an integer number of times as long as the shorter side walls, a plurality of spaced apart connectors equal in number to the integer number and extending away from the top wall in a single file, and a plurality of projections, equal in number to the integer number, extending from the interior surface of each of two opposing longer side walls below the bottom wall.

6. The first toy building block according to claim 5 having at least three connectors wherein the centerline spacing of at least one pair of adjoining projections on each of the longer side walls is greater than the centerline spacing between adjoining pairs of the connectors.

7. The first toy building block according to claim 6 where the shorter side walls lack projections engageable with the depressions of the connectors of second toy blocks identical to the first toy block.

8. The first toy building block according to claim 1 where the interior surfaces of two opposing side walls have projections engageable with the depressions of the at least one connector of second toy building blocks identical to the first toy building block and two other opposing side walls of the first toy building block lack projections engageable with the depressions of the at least one connector of second toy building blocks identical to the first toy building block.

9. The first toy building block of claim 1 having a plurality of spaced apart connectors extending away from the top wall in a single file and a plurality of central portions of the bottom wall equal in number to the plurality of connectors and extending in a single file along the bottom end, each central portion directly opposing a connector and each central portion being connected to at least two of the side walls by recessed portions of the bottom wall extending recessed between the central portion and the interior surfaces of the at least two side walls.

10. The first toy building block of claim 9 wherein each central portion is sized and shaped to be received within the interior surfaces of the plurality of partitions of any of the connectors of a second toy building block identical to the first toy building block and wherein each connector of the identical second toy building block is sized and shaped to be received between any of the central portions and at least two opposing side walls of the first toy building block.

11. A toy building block set comprising:

a first rectilinear polyhedron block according to claim 1 and a second rectilinear polyhedron block according to claim 1 and removably attachable to the first rectilinear polyhedron block, a length, width and height of each of the first and second rectilinear polyhedron blocks being generally equal, wherein a first predetermined force is required to remove the second rectilinear polyhedron block from the first rectilinear polyhedron block; and a third rectilinear polyhedron block according to claim 1 and a fourth rectilinear polyhedron block according to claim 1 and removably attachable to the third rectilinear polyhedron block, wherein two of a length, width and height of each of the third and fourth rectilinear polyhedron blocks are generally equal in dimension and wherein a remaining one of the length, width and height of each of the third and fourth rectilinear polyhedron blocks is at least three times the dimension of the other two, and wherein a second predetermined force required to remove the fourth rectilinear polyhedron block from the third rectilinear polyhedron block with the sidewalls of the fourth rectilinear polyhedron block coplanar with the sidewalls of the third rectilinear polyhedron block is less than three times the first predetermined force required to remove the second rectilinear polyhedron block from the first rectilinear polyhedron block.

12. The first toy building block according to claim 1 wherein the top wall and the bottom wall each have an interior surface facing and spaced apart from the interior surface of the other.

13. The first toy building block according to claim 1 wherein the interior surface of each of one opposing pair of the four side walls lacks any of the projections and depressions.

14. A first rectilinear polyhedron toy building block comprising:

a top wall;

four side walls extending orthogonally away from the top wall to a bottom end of the block, each of the four side walls having an interior surface facing a geometric center of the block and an opposing exterior surface exposed outside of the block;

at least one connector extending away from the top wall in a direction opposite the four side walls, the at least one connector including a plurality of partitions, each partition having an interior surface facing a geometric center of the connector and an opposing exterior surface, a free end and an opposing end affixed with the top wall;

a bottom wall spaced apart from the top wall and extending across the bottom end of the block within the four side walls;

a projection extending away from the interior surface of at least one of the side walls proximal the bottom end or from the exterior surface of one of the plurality of partitions; and a depression formed within the exterior surface of at least one of the plurality of partitions or within the interior surface of one of the plurality of side walls proximal the bottom end such that the one of the side walls bears proximal the bottom end either the projection or the depression and the one of the partitions bears a remaining one of the projection or the depression with the depression of the first toy building block being located, sized and shaped to receive the projection of a second toy building block identical to the first toy building block so as to releasably join the first and second toy building blocks;

wherein the exterior surface of each of at least two of the plurality of partitions of the at least one connector extends perpendicular with respect to the top wall from the top wall and each of the at least two partitions includes a depression in the perpendicular exterior surface; and wherein the depressions are formed in the exterior surfaces of each of two adjoining partitions of the at least one connector of the first toy building block and are different in shape from one another so as to engage with different strengths, one projection on a second toy building block identical to the first toy building block, the second toy building block being selectively orientable on the at least one connector of the first toy building block so as to releasably engage the one projection with each of the differently shaped depressions.

15. The first toy building block according to claim 14 wherein the entirety of the depression formed in the exterior surface of a first of the two adjoining partitions is spaced away from the free end of the first partition supporting such depression, beginning a predetermined non-zero distance away from the free end and ending more proximal to the second end of the first partition, whereby part of the exterior surface of the partition which is not a part of any depression separates the entirety of the depression from the free end; and wherein only a first portion of the depression formed in a second one of the two adjoining partitions is entirely spaced away from the free end of the second partition, beginning a non-zero distance away from the free end and terminating at a position farther from the free end and more proximal to the top wall and a second remaining portion of such depression extends along side of the first portion from the position more proximal to the top wall to and through the free end of the second partition.

16. The first toy building block according to claim 15 having a plurality of connectors extending away from the top wall, wherein the entirety of one depression in the exterior surface of at least two opposing partitions of each connector is spaced away from the free end of the partition supporting such depression, beginning a predetermined non-zero distance away from the free end and ending more proximal to the second end of the partition whereby part of the exterior surface of the partition, which is not a part of any depression, separates the entirety of the depression from the free end of the partition bearing the depression.

17. The first toy building block according to claim 16 wherein the top wall has a shorter dimension and a longer dimension at least three times as great as the shorter dimension, wherein the plurality of connectors are linearly arrayed along the longer dimension of the top wall, and wherein centerline spacing along the longer dimension of the top wall between immediately adjoining depressions in immediately adjoining partitions parallel to the longer dimension on immediately adjoining connectors is identical.

18. A first rectilinear polyhedron toy building block comprising:

a top wall;

four side walls extending orthogonally away from the top wall to a bottom end of the block, each of the four side walls having an interior surface facing a geometric center of the block and an opposing exterior surface exposed outside of the block;

at least one connector extending away from the top wall in a direction opposite the four side walls, the at least one connector including a plurality of partitions, each partition having an interior surface facing a geometric center of the connector and an opposing exterior surface, a free end and an opposing end affixed with the top wall; and a bottom wall spaced apart from the top wall and extending across the bottom end of the block within the four side walls, a projection extending away from the interior surface of at least one of the side walls proximal the bottom end;

the exterior surface of each of at least two of the plurality of partitions of the at least one connector is perpendicular to the top wall as the exterior surface extends away from the top wall and each of the at least two partitions includes a depression in the perpendicular exterior surface with the depression of the first toy building block being located, sized and shaped to receive the projection of a second toy building block identical to the first toy building block so as to releasably join the first and second toy building blocks; and the depressions formed in the exterior surfaces of the at least two partitions of the first toy block are different in shape from one another so as to engage with different strengths, one projection on a second toy building block identical to the first toy building block, the second toy building block being selectively orientable on the at least one connector of the first toy building block so as to releasably engage the one projection of the second toy building block with each of the differently shaped depressions.

* * * * *